US008960738B2

(12) United States Patent
Ishida et al.

(10) Patent No.: US 8,960,738 B2
(45) Date of Patent: Feb. 24, 2015

(54) DOOR HANDLE DEVICE FOR VEHICLE

(71) Applicant: Aisin Seiki Kabushiki Kaisha, Kariya-shi (JP)

(72) Inventors: Toshihiko Ishida, Niwa-gun (JP); Naoki Waichiku, Okazaki (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/241,741

(22) PCT Filed: Sep. 21, 2012

(86) PCT No.: PCT/JP2012/074247

§ 371 (c)(1),
(2) Date: Feb. 27, 2014

(87) PCT Pub. No.: WO2013/047377

PCT Pub. Date: Apr. 4, 2013

(65) Prior Publication Data

US 2014/0232121 A1 Aug. 21, 2014

(30) Foreign Application Priority Data

Sep. 29, 2011 (JP) ..... 2011-215215
Sep. 29, 2011 (JP) ..... 2011-215216
Sep. 29, 2011 (JP) ..... 2011-215217

(51) Int. Cl.
*E05B 3/00* (2006.01)
*E05B 83/40* (2014.01)
(Continued)

(52) U.S. Cl.
CPC . *E05B 3/00* (2013.01); *E05B 83/40* (2013.01); *E05B 85/10* (2013.01); *E05B 85/16* (2013.01)
USPC ..... 292/336.3; 292/347

(58) Field of Classification Search
CPC ..... E05B 85/16; E05B 85/18; E05B 85/14; Y10S 292/53
USPC ..... 292/336.3, 347, 348, 354, DIG. 31
See application file for complete search history.

(56) References Cited

U.S. PATENT DOCUMENTS 6,672,633 B2 * 1/2004 Nomura et al. ..... 292/336.3
6,749,236 B2 * 6/2004 Nomura et al. ..... 292/336.3

(Continued)

FOREIGN PATENT DOCUMENTS

JP 2002-322833 A 11/2002
JP 2005-188047 A 7/2005

(Continued)

OTHER PUBLICATIONS

International Search Report (PCT/ISA/210) mailed on Dec. 25, 2012, by the Japanese Patent Office as the International Searching Authority for International Application No. PCT/JP2012/074247.

(Continued)

*Primary Examiner* — Mark Williams
(74) *Attorney, Agent, or Firm* — Buchanan Ingersoll & Rooney PC

(57) ABSTRACT

A vehicle door handle device is configured so that, after a frame is assembled to an outer panel of a slide door, a link base, a connecting link, and a hand grip are mounted to the frame. Next, a lever and a cap are mounted to the hand grip and the frame, thereby assembling each component member to the outer panel. When the hand grip is moved through a door opening operation in the same direction as a slide door opening direction, an operation force for releasing a fully closed latch mechanism, which retains the slide door in a fully closed state, is generated. In addition, when the hand grip is moved through a door closing operation in the same direction as a slide door closing direction, an operation force for releasing a fully opened latch mechanism, which retains the slide door in a fully opened state, is generated.

12 Claims, 33 Drawing Sheets

(51) Int. Cl.
*E05B 85/10* (2014.01)
*E05B 85/16* (2014.01)

(56) References Cited

U.S. PATENT DOCUMENTS

| | | | | |
|---|---|---|---|---|
| 7,059,641 | B2 * | 6/2006 | Chanya | 292/336.3 |
| 7,152,893 | B2 * | 12/2006 | Pudney | 292/336.3 |
| 8,128,137 | B2 * | 3/2012 | Takaya et al. | 292/336.3 |
| 8,424,936 | B2 * | 4/2013 | Muller et al. | 292/336.3 |
| 8,783,742 | B2 * | 7/2014 | Puscas et al. | 292/336.3 |
| 2013/0161964 | A1 | 6/2013 | Ishida | |

FOREIGN PATENT DOCUMENTS

| | | | |
|---|---|---|---|
| JP | 2005-319866 | A | 11/2005 |
| JP | 2007-085032 | A | 4/2007 |
| JP | 2009-079352 | A | 4/2009 |
| JP | 2009-235849 | A | 10/2009 |
| JP | 2010-242442 | A | 10/2010 |
| JP | 2012-67491 | A | 4/2012 |
| JP | 2013-060787 | A | 4/2013 |
| WO | WO 2012/039089 | A1 | 3/2012 |

OTHER PUBLICATIONS

Written Opinion (PCT/ISA/237) mailed on Dec. 25, 2012, by the Japanese Patent Office as the International Searching Authority for International Application No. PCT/JP2012/074247.

English language translation of International Preliminary Report on Patentability (PCT/IB/373) issued by the International Bureau on Apr. 1, 2014 in International Application No. PCT/JP2012/074247 and English language translation of International Preliminary Report on Patentability. (8pgs).

Japanese Office Action issued on Oct. 28, 2014, by the Japan Patent Office, in corresponding Japanese Patent Application No. 2011-215216, and English language translation of Japanese Office Action. (4 pages).

Japanese Office Action issue Nov. 5, 2014, by the Japan Patent Office, in corresponding Japanese Patent Application No. 2011-215215, and English language translation of Japanese Office Action. (5 pages).

* cited by examiner

VEHICLE INNER SIDE ⟷ VEHICLE OUTER SIDE

DOOR HANDLE DEVICE FOR VEHICLE

TECHNICAL FIELD

The present invention relates to a door handle device for a vehicle, which is installed on a slide door of a vehicle, for performing opening and closing operations (door opening operation and door closing operation) of the slide door from an outer side of the slide door.

BACKGROUND ART

A door handle device for a vehicle of this type is disclosed, for example, in Patent Literature 1, and includes a frame fixed to an outer panel of a slide door from a door inner side and arranged along a vehicle front-rear direction, and a hand grip mounted to the frame and including a grip portion arranged at a door outer side with respect to the outer panel to extend along the vehicle front-rear direction.

CITATION LIST

Patent Literature

[PTL 1] JP 2007-85032 A

In the door handle device for a vehicle disclosed in Patent Literature 1, a configuration in which the frame and the hand grip are linked to each other through an intermediation of a connection mechanism (link mechanism) is adopted. When the hand grip is operated in one direction (door opening operation), the slide door in a fully closed state can be opened. In addition, when the hand grip is operated in the other direction (door closing operation), the slide door in a fully opened state can be closed. Therefore, in this door handle device for a vehicle, the hand grip can be operated in both directions, and hence the door handle device for a vehicle is superior in operability.

SUMMARY OF INVENTION

Technical Problem

Meanwhile, in the door handle device for a vehicle disclosed in Patent Literature 1, there is no description of an assembling method for linking, through an intermediation of the link mechanism, the frame and the hand grip to each other, which are arranged at the door inner side and the door outer side, respectively, with respect to the outer panel of the slide door. In actuality, the door handle device for a vehicle disclosed in Patent Literature 1 is assumed to have difficulty in assembling when linking the frame and the hand grip to each other through an intermediation of the link mechanism.

Solution to Problem and Actions and Effects

The present invention has been made to provide a door handle device for a vehicle, which is superior in operability and excellent in assemblability. The door handle device for a vehicle includes:

a frame configured to be fixed to an outer panel of a slide door of the vehicle from a door inner side and arranged along a vehicle front-rear direction;

a link base configured to be mountable to one end portion of the frame through the outer panel;

a connecting link rotatably mounted to the link base at a base end portion of the connecting link and being swingable in the vehicle front-rear direction;

a hand grip mounted to the outer panel from a door outer side;

a leg portion configured to be arranged at one end portion of the hand grip, rotatably mounted to a distal end portion of the connecting link, and inserted together with the link base and the connecting link to the one end portion of the frame through the outer panel;

an arm portion configured to be arranged at another end portion of the hand grip and inserted to another end portion of the frame through the outer panel, the arm portion including an insertion hole;

a grip portion arranged between the leg portion and the arm portion and extending along the vehicle front-rear direction at a vehicle outer side;

a cap mounted to the frame from the door outer side in a state in which the outer panel is sandwiched between the frame and the cap at the another end portion of the hand grip;

a lever mounted to the cap to be tiltable in a vehicle inward-outward direction and configured to be inserted into the insertion hole of the arm portion through the outer panel;

a first biasing member for biasing the hand grip toward an initial position relative to the frame; and a second biasing member for biasing the connecting link toward an initial position relative to the frame, in which when the hand grip is moved through a door opening operation in the same direction as a door opening direction to move the slide door in a fully closed state to an opened position, the hand grip is moved from the initial position in the door opening direction against a biasing force of the first biasing member and the lever tilts toward the vehicle outer side to generate an operation force for releasing a fully closed latch mechanism, which retains and locks the slide door in the fully closed state, and in which when the hand grip is moved through a door closing operation in the same direction as a door closing direction to move the slide door in a fully opened state to a closed position, the hand grip and the connecting link are moved from the initial positions in the door closing direction against a biasing force of the second biasing member and the connecting link swings in the door closing direction of the slide door to generate an operation force for releasing a fully opened latch mechanism, which retains and locks the slide door in the fully opened state.

Each operation force described above may be a mechanical operation force obtained when the hand grip is moved through the door opening operation or the door closing operation (operation force of the hand grip in a case where the hand grip and the fully closed latch mechanism or the fully opened latch mechanism are mechanically linked to each other) or may be an electrical operation force obtained when the hand grip is moved through the door opening operation or the door closing operation (electrical release force triggered by and obtained from an operation force of the hand grip in a case where the hand grip and the fully closed latch mechanism or the fully opened latch mechanism are electrically linked to each other).

Further, the above-mentioned door handle device for a vehicle of the present invention is configured in the following manner. Specifically, the hand grip is moved through the door opening operation in the same direction as the door opening direction to move the slide door in the fully closed state to the opened position, thereby generating the operation force for releasing the fully closed latch mechanism, which retains and locks the slide door in the fully closed state. In addition, the hand grip is moved through the door closing operation in the same direction as the door closing direction to move the slide door in the fully opened state to the closed position, thereby generating the operation force for releasing the fully opened latch mechanism, which retains and locks the slide door in the fully opened state. Therefore, each latch mechanism (fully closed latch mechanism for the slide door in the fully closed state and fully opened latch mechanism for the slide door in the fully opened state) can be released through the operation of the hand grip in a consistent direction (same direction) to the opening/closing direction of the slide door, and the slide door can be opened/closed. As a result, the door handle device for a vehicle is superior in operability.

Further, in the above-mentioned door handle device for a vehicle of the present invention, in advance, the connecting link is mounted together with the link base to the leg portion of the hand grip and the lever is mounted to the cap. Through the following assembling procedure, each component member (frame, link base, connecting link, hand grip, lever, cap, and the like) is assembled to the slide door. First, the frame is fixed to the outer panel of the slide door from the door inner side. Next, the connecting link mounted together with the link base to the leg portion of the hand grip is mounted to the one end portion of the frame through the outer panel through an intermediation of the link base, and the arm portion of the hand grip is inserted to the another end portion of the frame through the outer panel. Next, the lever mounted to the cap is inserted, through the outer panel, into the insertion hole arranged at the arm portion of the hand grip. After that, the cap is mounted to the frame. Note that, the above description of "through the outer panel" means "through a mounting hole or opening formed in the outer panel."

Meanwhile, the above-mentioned assembling procedure is an assembling procedure similar to a general conventional assembling procedure for the door handle device for a vehicle to which the present invention is applied. After assembling the frame to the outer panel of the slide door, the link base, the connecting link, and the hand grip are mounted to the frame. Next, the lever and the cap are mounted to the hand grip and the frame, thereby assembling each component member to the outer panel. As a result, the door handle device for a vehicle is superior in assemblability.

When carrying out the present invention as described above, the door handle device for a vehicle may further include:

a guided portion arranged at the arm portion of the hand grip;

a first guide portion arranged at the frame; and a second guide portion arranged at the frame, in which when the hand grip is moved through the door opening operation in the same direction as the door opening direction to move the slide door in the fully closed state to the opened position, the hand grip is moved from the initial position in the door opening direction against the biasing force of the first biasing member, the lever tilts toward the vehicle outer side, and the guided portion moves along the first guide portion in the door opening direction of the slide door to generate the operation force for releasing the fully closed latch mechanism, which retains the slide door in the fully closed state, and in which when the hand grip is moved through the door closing operation in the same direction as the door closing direction to move the slide door in the fully opened state to the closed position, the hand grip and the connecting link are moved from the initial positions in the door closing direction against the biasing force of the second biasing member, the connecting link swings in the door closing direction of the slide door, and the guided portion moves along the second guide portion in the door closing direction of the slide door to generate the operation force for releasing the fully opened latch mechanism, which retains the slide door in the fully opened state.

In this case, in the above-mentioned door handle device for a vehicle of the present invention, the movement of the hand grip operated in the same direction as the door opening direction to move the slide door in the fully closed state to the opened position involves the movement of the hand grip from the initial position in the door opening direction against the biasing force of the first biasing member, the tilt of the lever toward the vehicle outer side, and the movement of the guided portion, which is arranged at the arm portion, along the first guide portion, which is arranged at the frame, in the door opening direction of the slide door. Further, the movement of the hand grip operated in the same direction as the door opening direction involves the tilt of the hand grip about a connection center between the leg portion of the hand grip and the connecting link toward a door opened position at the vehicle outer side.

In addition, the movement of the hand grip operated in the same direction as the door closing direction to move the slide door in the fully opened state to the closed position involves the movement of the hand grip and the connecting link from the initial positions in the door closing direction against the biasing force of the second biasing member, the swing of the connecting link in the door closing direction of the slide door, and the movement of the guided portion, which is arranged at the arm portion, along the second guide portion, which is arranged at the frame, in the door closing direction of the slide door. Further, the movement of the hand grip operated in the same direction as the door closing direction involves the movement of a connection portion between the leg portion of the hand grip and the connecting link in the door closing direction. In accordance with such movement of the hand grip, the connecting link swings about a connection center between the connecting link and the link base in the door closing direction of the slide door.

Accordingly, a movement amount of the hand grip when the slide door is moved to the opened position (i.e., a tilt amount of the hand grip about the connection center between the leg portion of the hand grip and the connecting link toward the door opened position at the vehicle outer side) can be necessarily sufficiently secured. In addition, a movement amount of the hand grip when the slide door is moved to the closed position (i.e., a swing amount of the connecting link about the connection center between the connecting link and the link base in the door closing direction) can be necessarily sufficiently secured. Therefore, each operation of the hand grip can be appropriately performed.

Further, when carrying out the present invention as described above, the door handle device for a vehicle may further include:

an inertia stopper tiltable relative to the lever; and a third biasing member for biasing the inertia stopper toward an initial position relative to the lever, in which when a predetermined inertia acts in the door closing direction of the slide door, the inertia stopper is separated from the lever against a biasing force of the third biasing member and the arm portion of the hand grip is engaged with the separated inertia stopper to restrict the hand grip from moving in the door closing direction.

In this case, when the predetermined inertia acts in the door closing direction of the slide door due to collision of the vehicle or the like, the inertia stopper is separated from the lever to tilt by a predetermined amount and the arm portion of the hand grip is engaged with the inertia stopper to restrict the hand grip from moving in the door closing direction. Therefore, even when the above-mentioned inertia acts on the device, the hand grip is not moved in the door closing direction by the inertia. For example, in the vehicle in which the slide door is in the fully opened state, the operation force for releasing the fully opened latch mechanism, which retains and locks the slide door in the fully opened state, is not generated. As a result, a measure against the inertia due to the above-mentioned collision of the vehicle or the like (safety improvement so as not to generate the operation force for releasing the fully opened latch mechanism) can be taken by a simple configuration (configuration in which the inertia stopper and the third biasing member are arranged at the lever).

Further, when carrying out the present invention as described above, the door handle device for a vehicle may further include an anti-loosening protrusion arranged at the frame to prevent the hand grip from loosening from the frame when the lever is inserted into the insertion hole formed in the arm portion. In this case, the hand grip can be prevented from loosening from the frame by the anti-loosening protrusion arranged at the frame. Therefore, mountability of the lever and the cap to the hand grip and the frame can be improved.

To meet the above-mentioned demand (reduction in operation force), in the present invention, the door handle device for a vehicle further includes a closing operation switch configured to detect that the hand grip is operated in the door closing direction of the slide door, in which when the closing operation switch detects that the hand grip is operated in the door closing direction of the slide door, the slide door retained and locked in the fully opened state by the fully opened latch mechanism is released by an electrical actuator.

In the above-mentioned door handle device for a vehicle of the present invention, locking of the fully opened latch mechanism can be released by an electrical drive method (an operation force applied to the hand grip 121 is regarded as a trigger, and when this trigger is detected by the closing operation switch, retaining and locking of the fully opened latch mechanism is released by a drive force obtained from the electrical actuator). Therefore, the operation force of the hand grip in the door closing direction (operation force required to release locking of the fully opened latch mechanism) can be reduced in the door closing operation of the slide door.

When carrying out the present invention as described above, the closing operation switch may be removably mounted to the frame. In this case, the hand grip can be mounted to the frame in a state in which the closing operation switch is not mounted to the frame. When mounting the hand grip to the frame, the closing operation switch or wire harness mounted to this switch does not hinder, and hence mountability of the hand grip to the frame can be improved.

Moreover, when carrying out the present invention as described above, the closing operation switch may be arranged to correspond to an end portion of the hand grip, which is close to an end portion of the slide door (to an end portion of the hand grip, which is located in proximity to an end portion of the slide door). In this case, a short-length routing of the wire harness mounted to the closing operation switch to be pulled out from the closing operation switch (routing in the slide door, for example, by bypassing a window) can be easily established in the slide door, compared with a case where the closing operation switch is arranged to correspond to an end portion of the hand grip, which is close to an intermediate portion of the slide door. Therefore, mountability of the wire harness can be improved and costs can be reduced.

Further, when carrying out the present invention as described above, the device may further include an opening operation switch configured to detect that the hand grip is operated in the door opening direction of the slide door, in which when the opening operation switch detects that the hand grip is operated in the door opening direction of the slide door, the slide door retained and locked in the fully closed state by the fully closed latch mechanism is released by the electrical actuator. In this case, both locking of the fully closed latch mechanism and locking of the fully opened latch mechanism can be released by an electrical drive method. Therefore, the operation force of the hand grip (operation force required to release locking of each latch mechanism) can be reduced in any of the door opening operation and the door closing operation of the slide door.

Further, when carrying out the present invention as described above, the closing operation switch and the opening operation switch may be arranged to correspond to the end portion of the hand grip, which is close to the end portion of the slide door. In this case, mountability of each wire harness mounted to each switch to be pulled out from each switch can be improved and costs can be reduced. In addition, a grounding wire in each wire harness can be shared. Therefore, the wire harness can be substantially formed by three electrical wires. With this configuration as well, costs can be reduced.

Further, when carrying out the present invention as described above, the closing operation switch and the opening operation switch may be integrated with each other. In this case, mountability of the closing operation switch and the opening operation switch can be improved (man-hours for mounting can be reduced) compared with a case where the closing operation switch and the opening operation switch are separately provided and respectively mounted.

To achieve common application of components between a bi-directional door handle device and a unidirectional door handle device, in the device of the present invention, the distal end portion of the connecting link and the link base may be configured to be integrally connectable to each other and the leg portion of the hand grip may be configured to be rotatable relative to the distal end portion of the connecting link and the link base.

In this door handle device for a vehicle, the hand grip is operable in the door opening direction of the slide door and the hand grip is operable in the door closing direction of the slide door. Therefore, the door handle device for a vehicle is a bi-directional door handle device. Meanwhile, in this door handle device for a vehicle, the distal end portion of the connecting link and the link base may be integrally connectable to each other and the leg portion of the hand grip may be rotatable relative to those components (distal end portion of the connecting link and link base).

Accordingly, the connecting link can be configured so as not to swing in the door closing direction of the slide door and the hand grip can be prevented from operating in the door closing direction of the slide door. Therefore, the device can be configured as a unidirectional door handle device. Consequently, in the door handle device for a vehicle of the present invention, in a case where the device is configured as a unidirectional door handle device, the link base, the connecting link, the hand grip, and the like can be applied as common components, and hence costs can be reduced through common application of components.

When carrying out the present invention as described above, the base end portion of the connecting link may be rotatably mounted to the link base through an intermediation of a first connecting pin and the leg portion of the hand grip may be rotatably mounted to the distal end portion of the connecting link through an intermediation of a second connecting pin, and through use of the first connecting pin, the distal end portion of the connecting link and the link base may be configured to be integrally connectable to each other and the leg portion of the hand grip may be configured to be rotatable relative to the distal end portion of the connecting link and the link base. In this case, the first connecting pin can also be used as a common component and costs can be further reduced.

DESCRIPTION OF EMBODIMENTS

Figure 1:
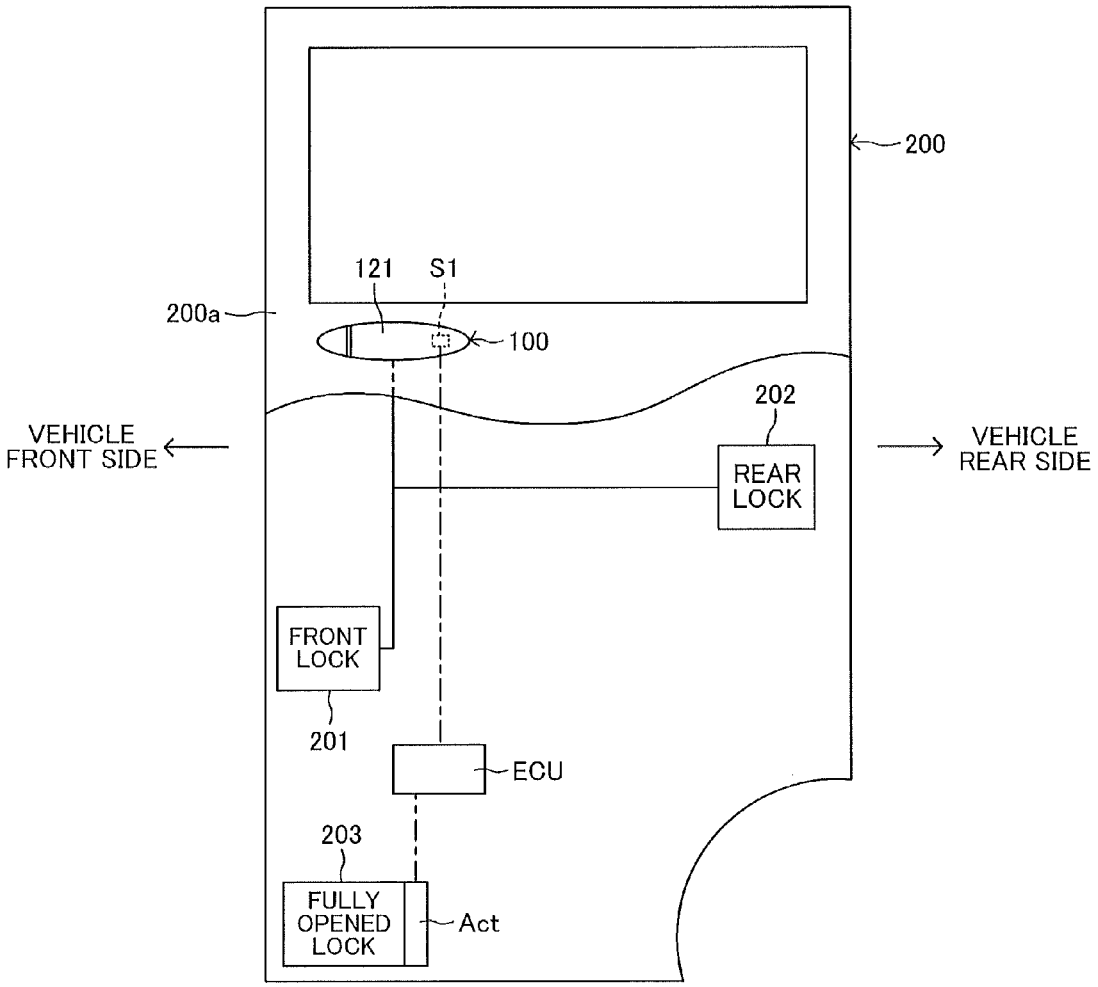
FIG. 1 is a side view schematically illustrating a slide door for a vehicle including a door handle device for a vehicle according to a first embodiment of the present invention.
Figure 2:
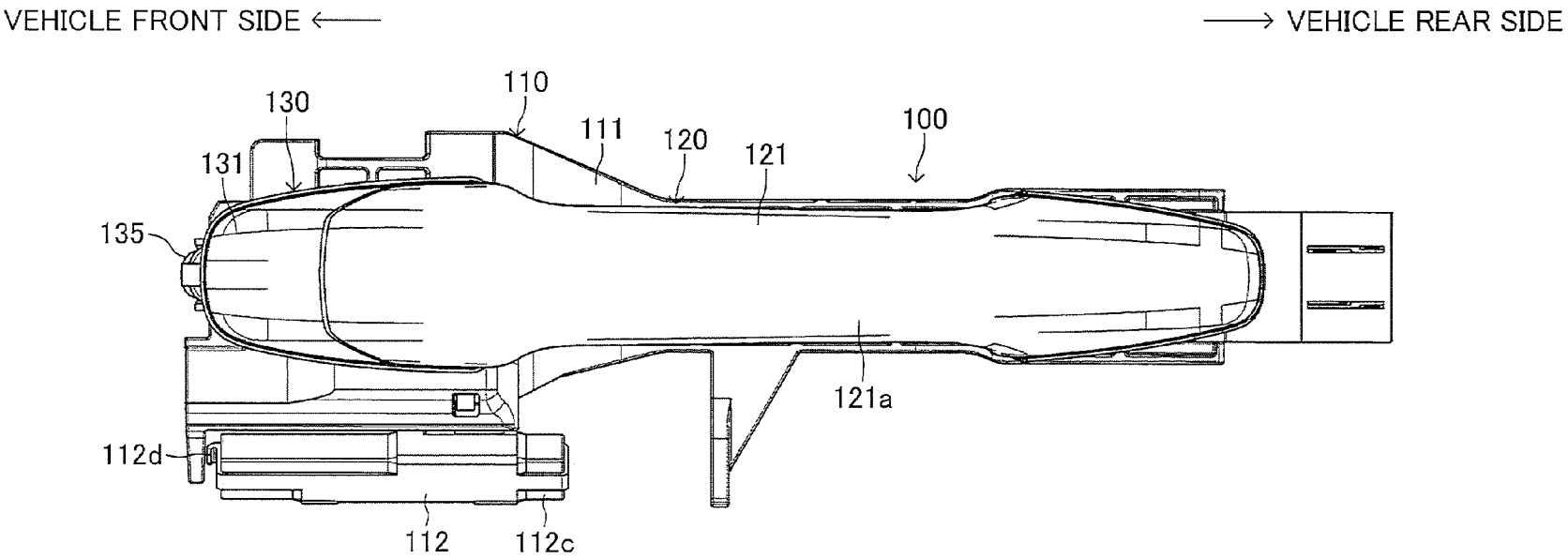
FIG. 2 is a side view (view seen from the outside of the vehicle) illustrating a main configuration of the door handle device for a vehicle illustrated in FIG. 1.
Figure 3:
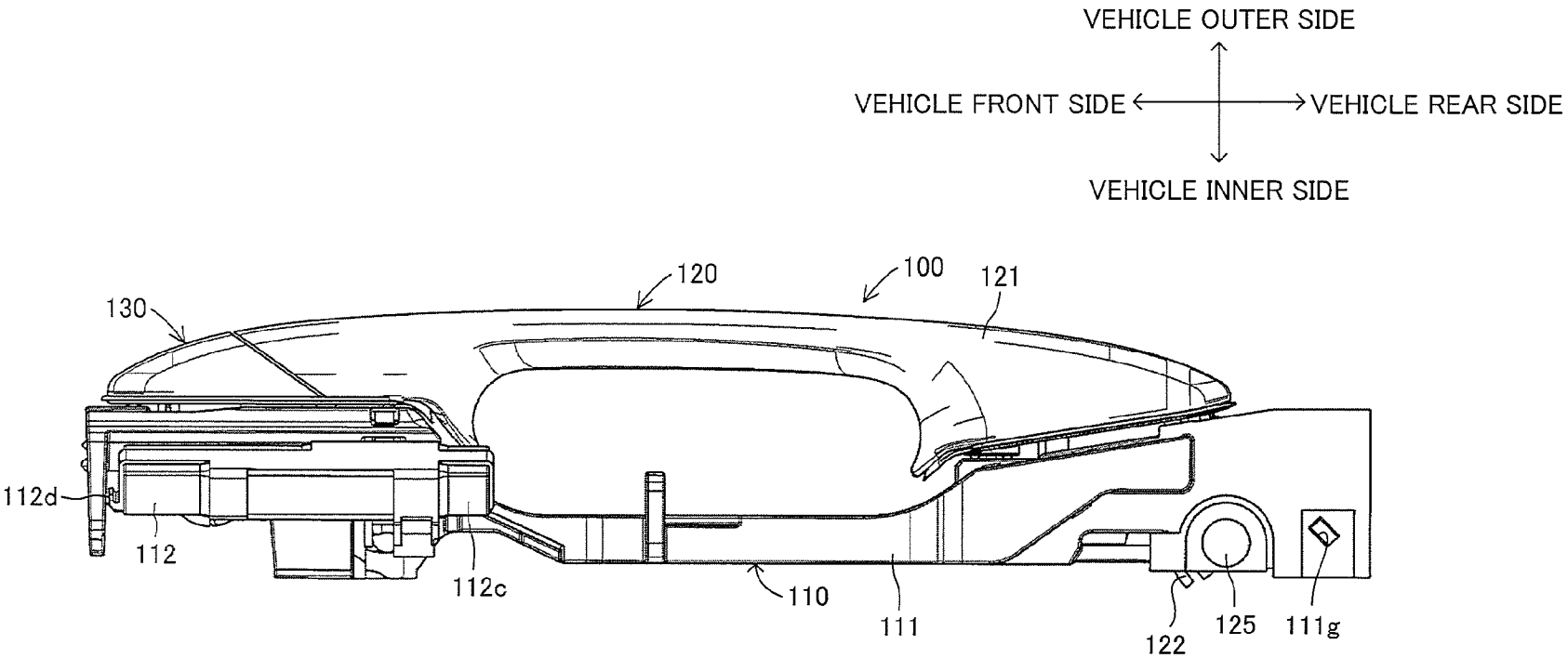
FIG. 3 is a bottom view of the door handle device for a vehicle illustrated in FIG. 2.
Figure 4:
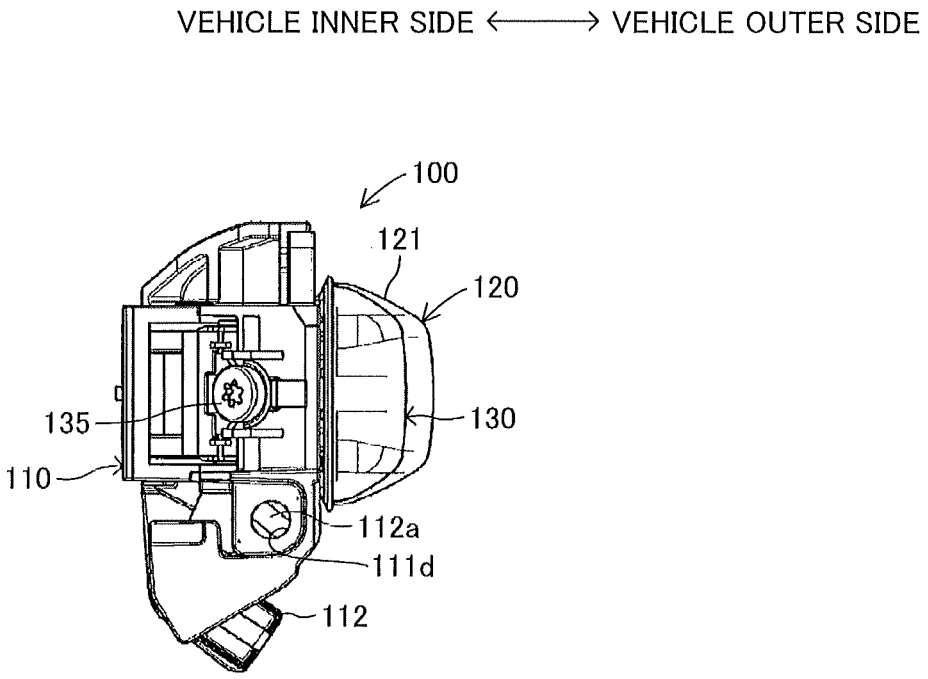
FIG. 4 is a front view (view seen from the front side of the vehicle) of the door handle device for a vehicle illustrated in FIG. 2.
Figure 5:
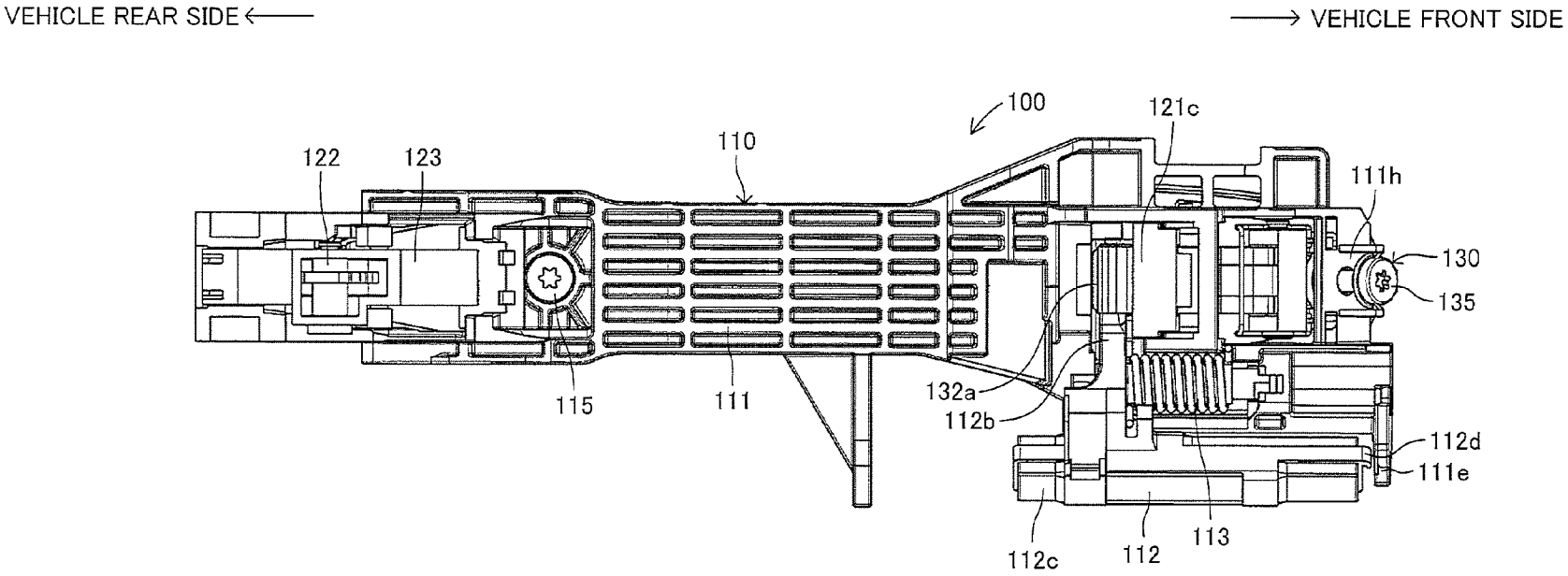
FIG. 5 is a rear view (view seen from the inner side of the vehicle) of the door handle device for a vehicle illustrated in FIG. 2.
Figure 6:
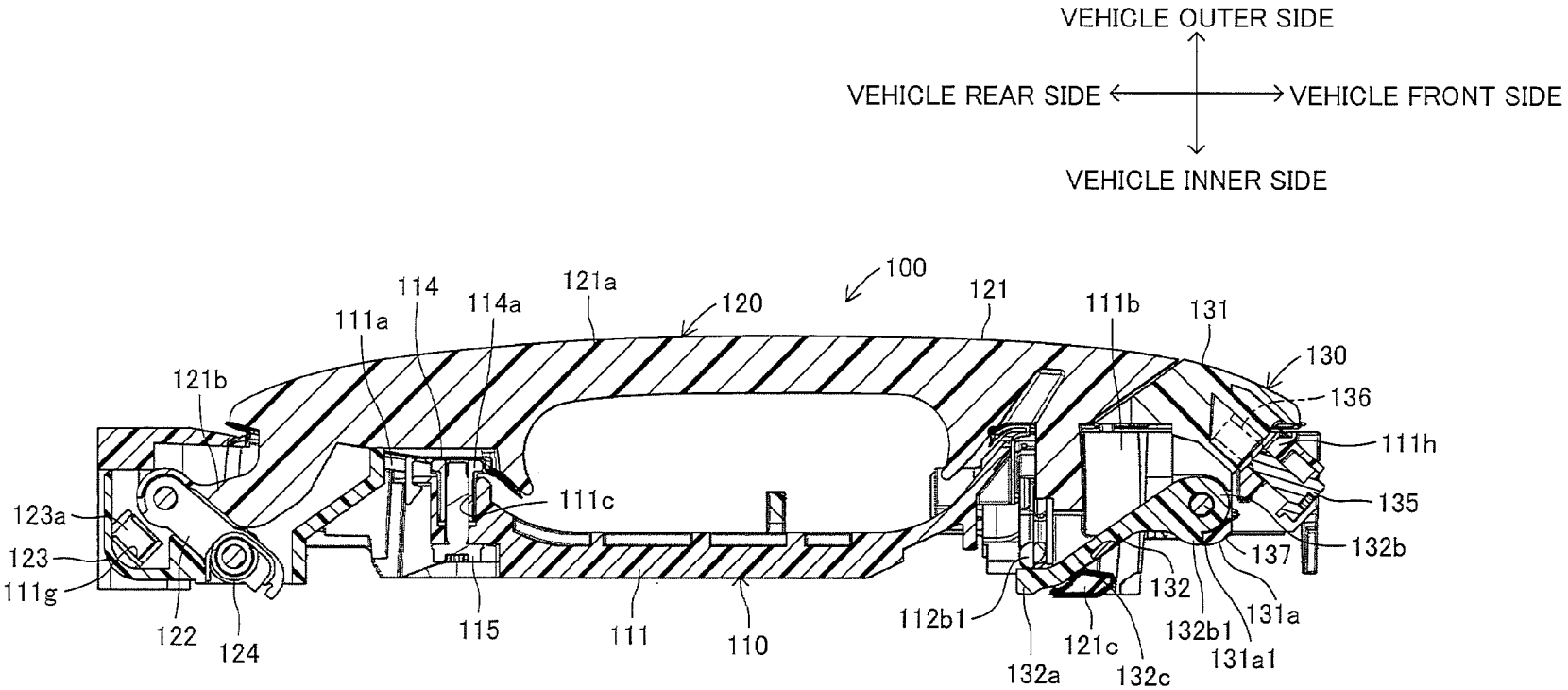
FIG. 6 is a cross-sectional plan view of the door handle device for a vehicle illustrated in FIG. 5, which is taken transversely along the center line of the door handle device for a vehicle.

Now, embodiments of the present invention are described with reference to the drawings. FIG. 1 illustrates a door handle device 100 for a vehicle according to a first embodiment of the present invention. This door handle device 100 for a vehicle of the first embodiment is configured to mechanically link to a font lock 201 and a rear lock 202 which are mounted on a slide door 200, and to electrically link to a fully opened lock 203 which is mounted on the slide door 200. Note that, the door handle device 100 for a vehicle illustrated in FIG. 1 is arranged at a vehicle front side portion of the slide door 200 (portion in proximity to a front end portion of the slide door 200).

The slide door 200 is movable in a vehicle front-rear direction at a side portion of the vehicle, and is configured to open and close an opening portion formed in a vehicle body (not shown) for getting in/out of the vehicle (in particular, configured to move the slide door 200 from a fully closed position (position for closing the opening portion for getting in/out of the vehicle) in a vehicle rearward direction so as to open the opening portion for getting in/out of the vehicle, and to move the slide door 200 toward the fully closed position in a vehicle forward direction so as to close the opening portion for getting in/out of the vehicle). The front lock 201 and the rear lock 202 serve to retain and lock the slide door 200 in a fully closed state (state in which the opening portion for getting in/out of the vehicle is closed) (i.e., serve as a fully closed latch mechanism), and the front lock 201 and the rear lock 202 are arranged at the vehicle front side portion and a vehicle rear side portion of the slide door 200, respectively. The fully opened lock 203 serves to retain and lock the slide door 200 in a fully opened state (state in which the opening portion for getting in/out of the vehicle is opened) (i.e., serves as a fully opened latch mechanism), and the fully opened lock 203 is arranged at a lower portion of a vehicle front side of the slide door 200. Note that, if only the rear lock 202 can retain and lock the slide door 200 in the fully closed state, the front lock 201 need not be arranged.

Figure 28:
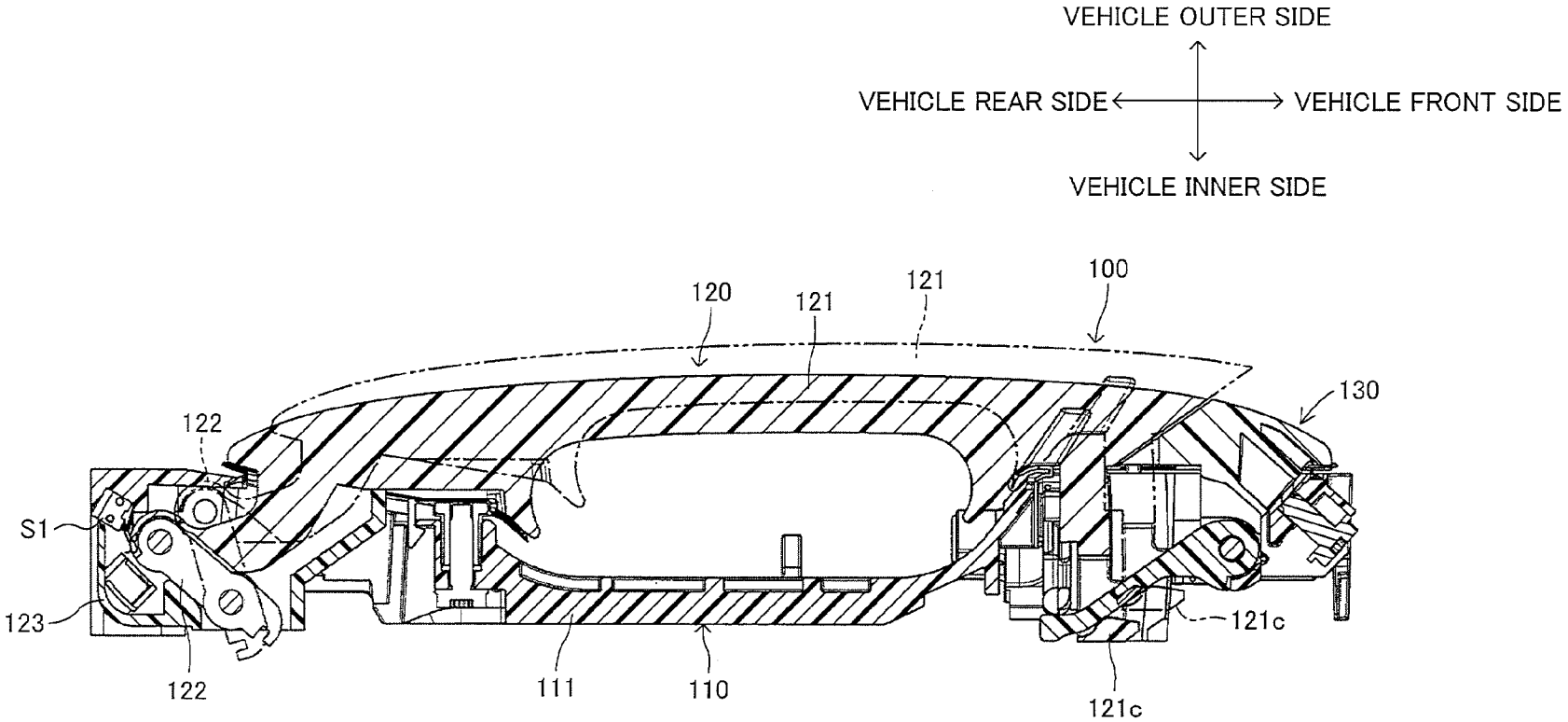
FIG. 28 is a cross-sectional plan view taken transversely along the center line of the door handle device for a vehicle corresponding to FIG. 6, for illustrating a relation between a closing operation switch assembled to a vehicle rear portion of the frame (one embodiment) and the hand grip.
Figure 29:
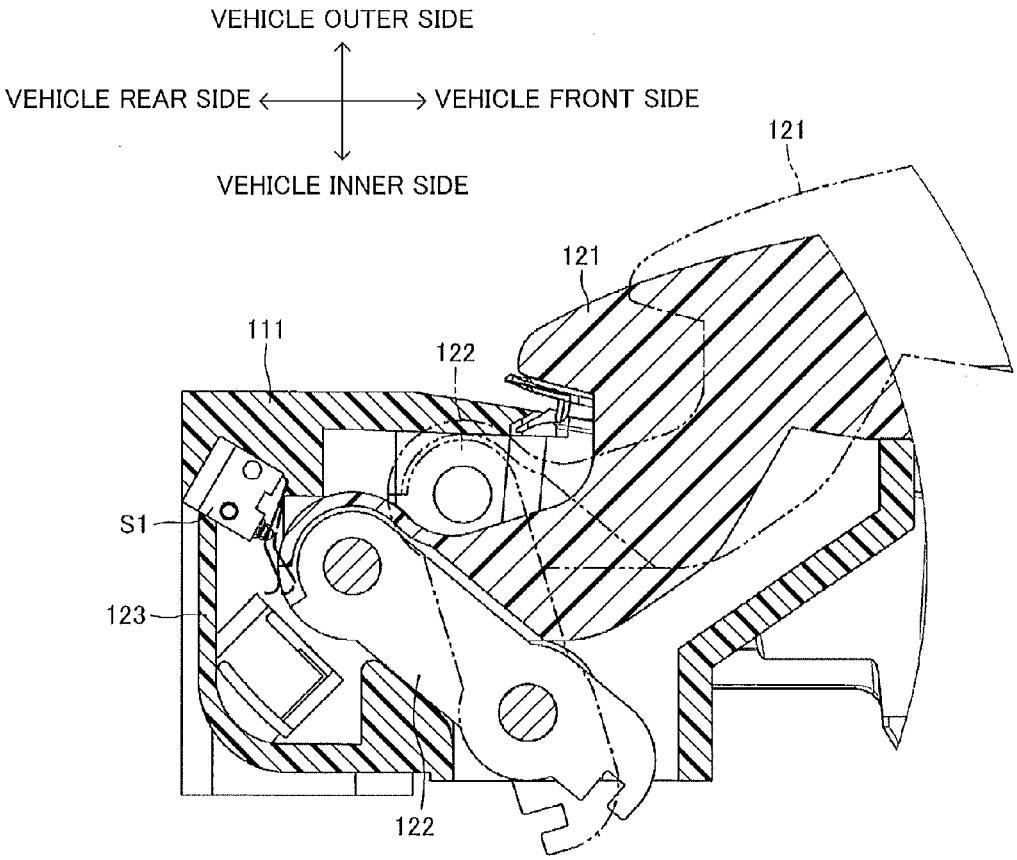
FIG. 29 is an enlarged view of a left portion (vehicle rear portion) of FIG. 28.
Figure 30:
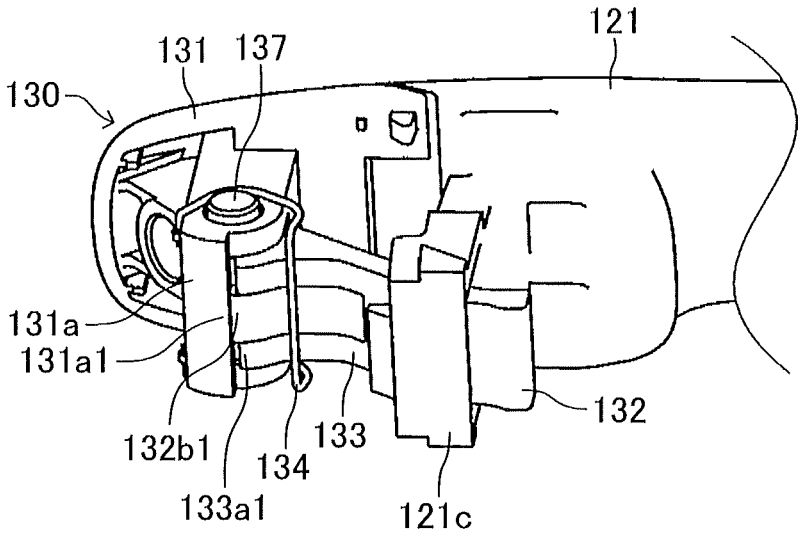
FIG. 30 is a perspective view illustrating a relation between a lever of the cap assembly illustrated in FIGS. 16 to 19 and the hand grip (relation when the lever and the hand grip are both in initial positions).
Figure 31:
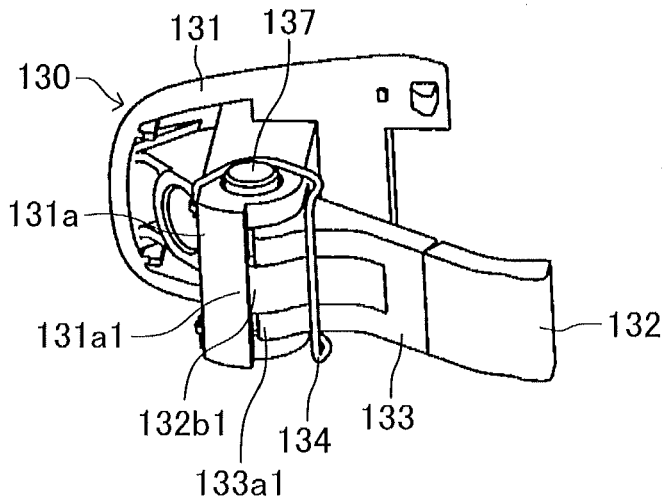
FIG. 31 is a perspective view of a state in which the hand grip is removed from FIG. 30.
Figure 32:
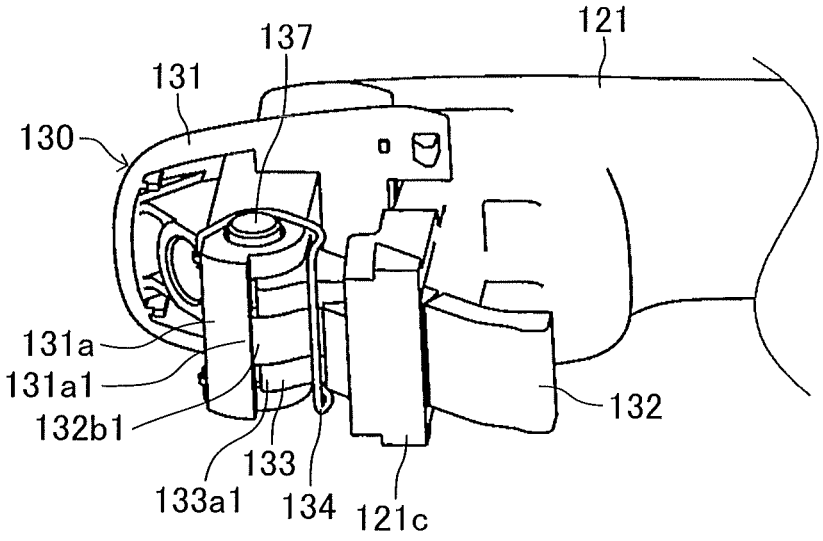
FIG. 32 is a perspective view of a state in which a door closing operation of the hand grip illustrated in FIG. 30 is performed.
Figure 33:
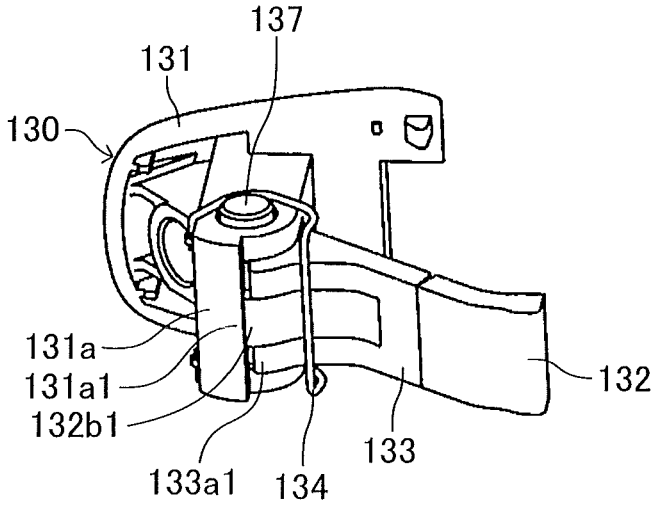
FIG. 33 is a perspective view of a state in which the hand grip is removed from FIG. 32.

As illustrated in FIGS. 2 to 7, the door handle device 100 for a vehicle includes a base assembly 110 (see FIGS. 8 to 11) to be mounted to an outer panel 200*a* (see FIG. 1) of the slide door 200, and a handle assembly 120 (see FIGS. 12 to 15) to be mounted to a frame 111 of the base assembly 110, a cap assembly 130 (see FIGS. 16 to 19), and a closing operation switch S1 (see FIGS. 1, 28, and 29).

As illustrated in FIGS. 2 to 7 and FIGS. 8 to 11, the base assembly 110 includes the frame 111, a bell crank 112, a spring 113, a nut 114, and the like. The frame 111 is configured to be fixed to the outer panel 200*a* of the slide door 200 from a door inner side, and the frame 111 includes a rear opening 111*a* at a vehicle rear portion (right portion in FIG. 8) and a front opening 111*b* at a vehicle front portion (left portion in FIG. 8). Note that, the frame 111 is configured to be assembled to the outer panel 200*a* by using the nut 114 which is mounted to a stepped mounting hole 111*c* of the frame 111 from a door outer side through the outer panel 200*a* of the slide door 200 and which has a flange portion 114*a* engaged with the frame 111 through an intermediation of the outer panel 200*a*, and a screw 115 (see FIGS. 5 and 6) which is threadingly engaged with the nut 114 from the door inner side. Note that, the above description of "through the outer panel 200*a*" means "through a mounting hole or opening (both not shown) formed in the outer panel 200*a*" in detail, and the same applies in the following description.

The bell crank 112 is mounted to a mounting hole 111*d* of the frame 111 so as to be rotatable about its shaft portion 112*a*, and is movable relative to the frame 111 in a predetermined distance in an axial direction of the shaft portion 112*a*. In addition, the bell crank 112 includes an input portion 112*b* linked to an arm portion 121*c* of a hand grip 121 through an intermediation of a lever 132 of the cap assembly 130, and an output portion 112*c* mechanically linked to the front lock 201 and the rear lock 202 through an intermediation of a link mechanism (not shown). Note that, the bell crank 112 includes a lock pawl 112*d* (engageable with and disengageable from an engagement retaining portion 111*e* of the frame 111) for temporarily retaining the bell crank 112 in a temporary retaining position during assembling of the handle assembly 120 and the cap assembly 130 to the frame 111 (position in which the input portion 112*b* of the bell crank 112 does not hinder during assembling of the handle assembly 120 and the cap assembly 130 to the frame 111). Such a configuration is a technique disclosed in JP 2003-41811 A.

The spring 113 is a first biasing member for biasing the bell crank 112 toward an initial position relative to the frame 111. The spring 113 is mounted, at a coil portion, on an outer periphery of the shaft portion 112*a* of the bell crank 112, and an end of the spring 113 is elastically engaged with the frame 111 while the other end of the spring 113 is elastically engaged with the bell crank 112. Therefore, the spring 113 biases the bell crank 112 by a predetermined biasing force so as to rotate the bell crank 112 in a direction in which a distal end 112*b*1 (see FIG. 6) of the input portion 112*b* of the bell crank 112 is elastically engaged with the arm portion 121*c* of the hand grip 121 through an intermediation of a distal end portion 132*a* of the lever 132 (in a counterclockwise direction in FIG. 4). Consequently, the distal end 112*b*1 of the input portion 112*b* in the bell crank 112 is elastically engaged with the arm portion 121*c* of the hand grip 121 through an intermediation of the lever 132.

As illustrated in FIGS. 2 to 7 and FIGS. 12 to 15, the handle assembly 120 includes the hand grip 121, a connecting link 122, a link base 123, a spring 124, and the like. The hand grip 121 includes a grip portion 121*a* extending along the vehicle front-rear direction, a leg portion 121*b* arranged at one end portion (vehicle rear end portion) of this grip portion 121*a*, and the arm portion 121*c* arranged at the other end portion (vehicle front end portion) of the grip portion 121*a*. The grip portion 121*a* is formed between the leg portion 121*b* and the arm portion 121*c*. The grip portion 121*a* is a portion arranged at a vehicle outer side with respect to the outer panel 200*a* of the slide door 200 and is manually operable when the door opening and closing operations of the slide door 200 are performed (at the time of door opening operation and at the time of door closing operation). The leg portion 121*b* is connected to the link base 123 through an intermediation of the connecting link 122. The arm portion 121*c* is connected to the above-mentioned bell crank 112 through an intermediation of the lever 132 of the cap assembly 130.

Figure 13:
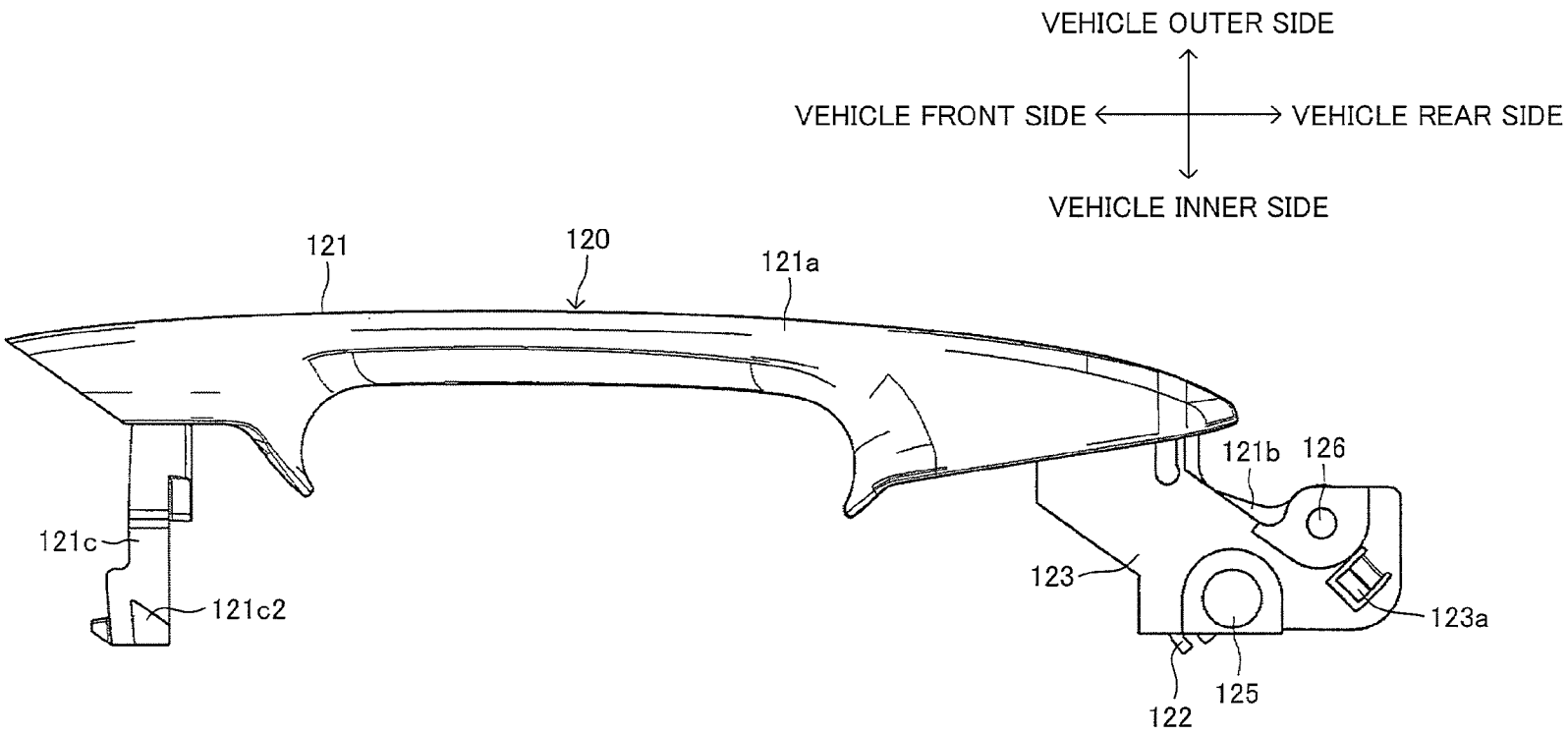
FIG. 13 is a bottom view of the handle assembly illustrated in FIG. 12.
Figure 14:
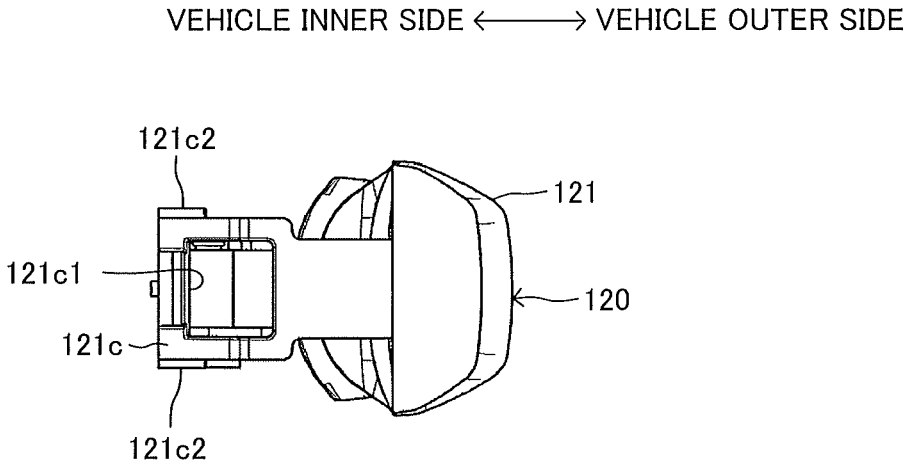
FIG. 14 is a front view of the handle assembly illustrated in FIG. 12.
Figure 15:
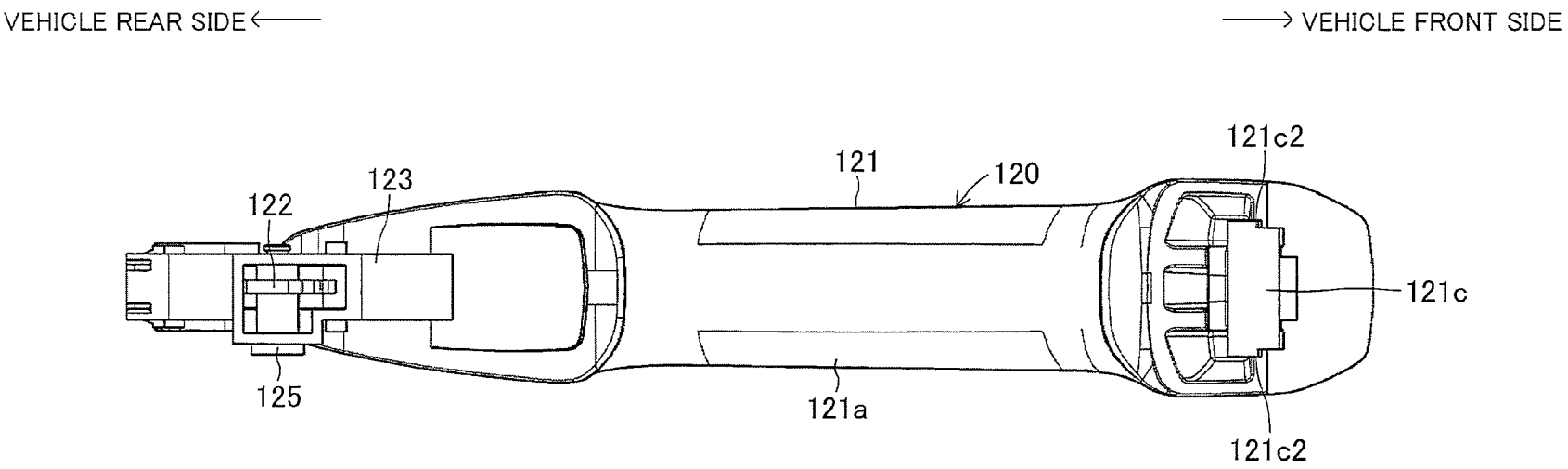
FIG. 15 is a rear view of the handle assembly illustrated in FIG. 12.
Figure 16:
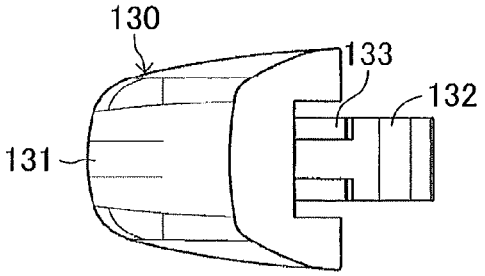
FIG. 16 is a side view of a cap assembly in the door handle device for a vehicle illustrated in FIG. 2.
Figure 17:
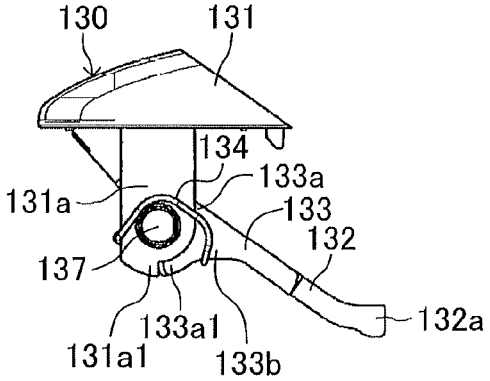
FIG. 17 is a bottom view of the cap assembly illustrated in FIG. 16.
Figure 18:
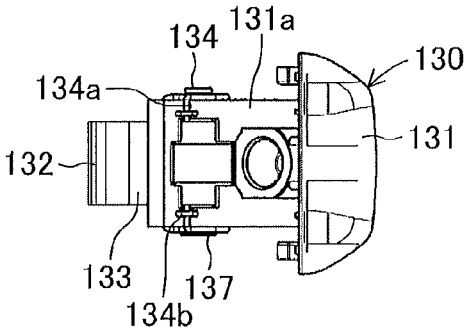
FIG. 18 is a front view of the cap assembly illustrated in FIG. 16.
Figure 19:
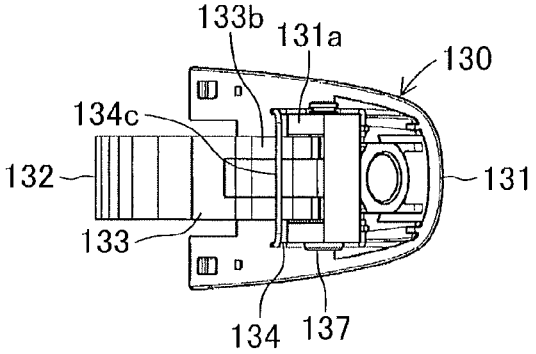
FIG. 19 is a rear view of the cap assembly illustrated in FIG. 16.

A rectangular insertion hole 121*c*1 through which the distal end portion 132*a* of the lever 132 can be inserted is formed in this arm portion 121*c*, and a pair of protrusions (guided portions) 121*c*2 engageable with a pair of guides 111*f* arranged at the frame 111 is formed at the arm portion 121*c*. As illustrated in FIG. 13, each of the protrusions 121*c*2 is configured in the following manner. Specifically, an end surface on the vehicle outer side (end surface at an upper side in FIG. 13) is formed into a shape inclined toward the vehicle front side relative to the vehicle outer side to form a substantial trapezoid as a whole. When a door opening operation (opening operation) of the hand grip 121 is performed as indicated by the dashed lines in FIGS. 24 to 27, each protrusion 121*c*2 moves along a first guide groove 111*f*1 of each guide 111*f*. When a door closing operation (closing operation) of the hand grip 121 is performed as indicated by the two-dot chain lines in FIGS. 24 to 27, each protrusion 121*c*2 moves along a second guide groove 111*f*2 of each guide 111*f*.

The first guide groove **111*f*1 of each guide 111*f* extends in a vehicle inward-outward direction. This first guide groove 111*f*1 guides the protrusion 121*c*2 of the hand grip 121 so that the protrusion 121*c*2 moves toward the vehicle outer and rear sides when the door opening operation of the hand grip 121 is performed. Meanwhile, the second guide groove 111*f*2 of each guide 111*f* is connected, at a rear end thereof, to an end portion (vehicle inner end portion) of the first guide groove 111*f*1 to extend in the vehicle front-rear direction. This second guide groove 111*f*2 is inclined in the vehicle front-rear direction, and a front end of the second guide groove 111*f*2 is positioned at the vehicle outer side compared to a rear end of the second guide groove 111*f*2. The second guide groove 111*f*2 guides the protrusion 121*c*2 of the hand grip 121 so that the protrusion 121*c*2 moves toward the vehicle outer and front sides when the door closing operation of the hand grip 121 is performed (see FIG. 27**).

The above-mentioned door opening operation is an operation to open the slide door 200 in the fully closed state. At this time, the hand grip 121 is operated in the same direction as a door opening direction (in the vehicle rearward direction) to move the slide door 200 to an opened position. Therefore, the hand grip 121 indicated by the dashed lines in FIGS. 24 to 26 moves rearward at the vehicle outer side relative to the hand grip 121 in an initial position. Meanwhile, the above-mentioned door closing operation is an operation to close the slide door 200 in the fully opened state. At this time, the hand grip 121 is operated in the same direction as a door closing direction (in the vehicle forward direction) to move the slide door 200 to a closed position. Therefore, the hand grip 121 indicated by the two-dot chain lines in FIGS. 24 to 26 moves forward at the vehicle outer side relative to the hand grip 121 in the initial position.

Figure 7:
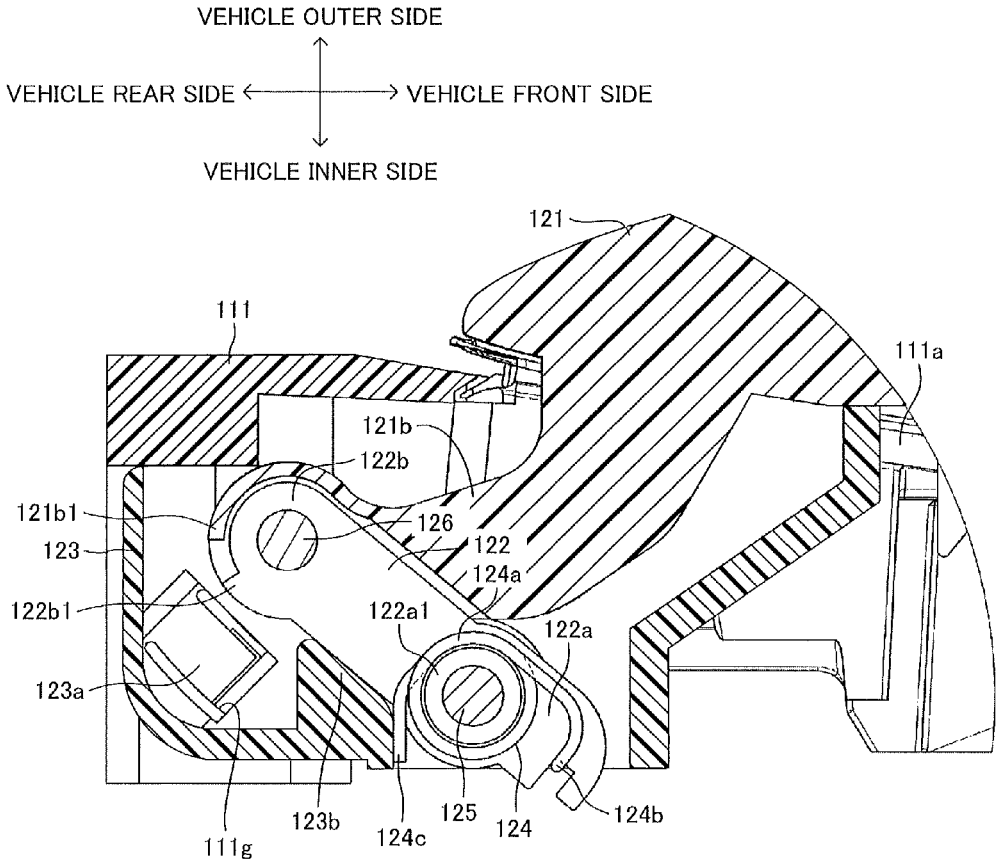
FIG. 7 is an enlarged view of a left portion (vehicle rear portion) of FIG. 6.
Figure 8:
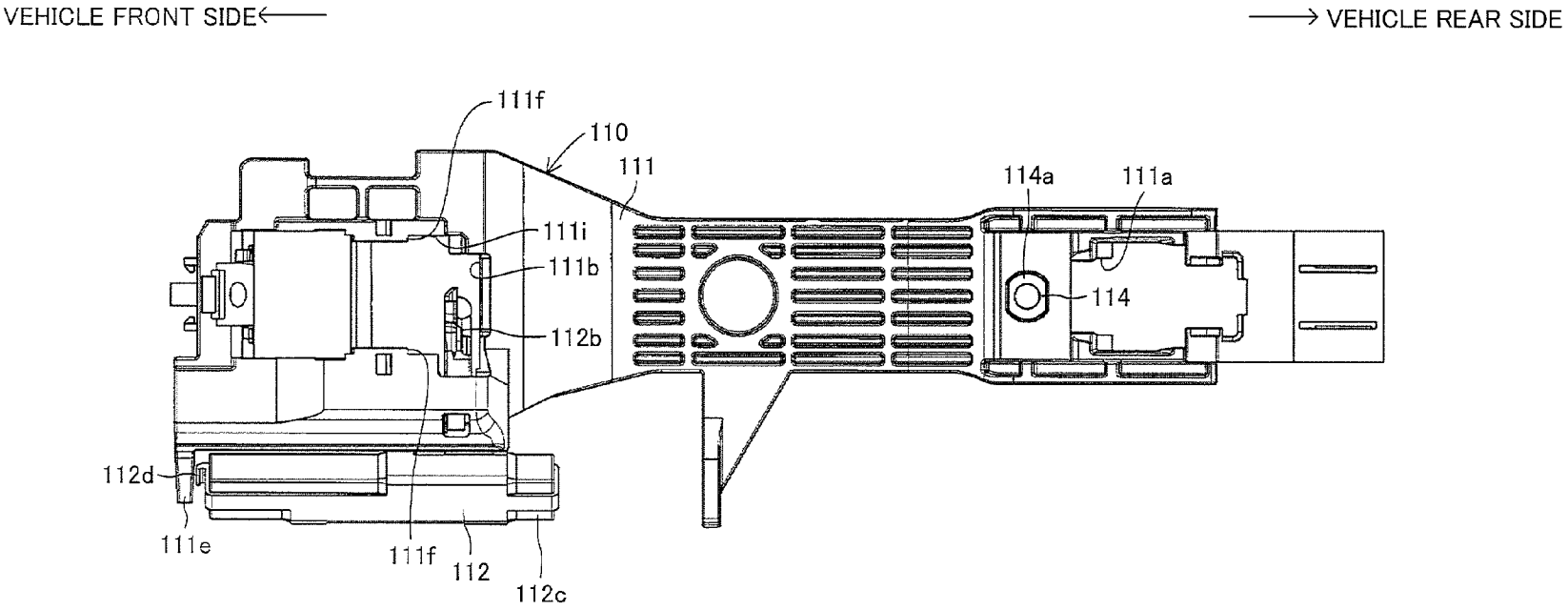
FIG. 8 is a side view of a base assembly in the door handle device for a vehicle illustrated in FIG. 2.
Figure 9:
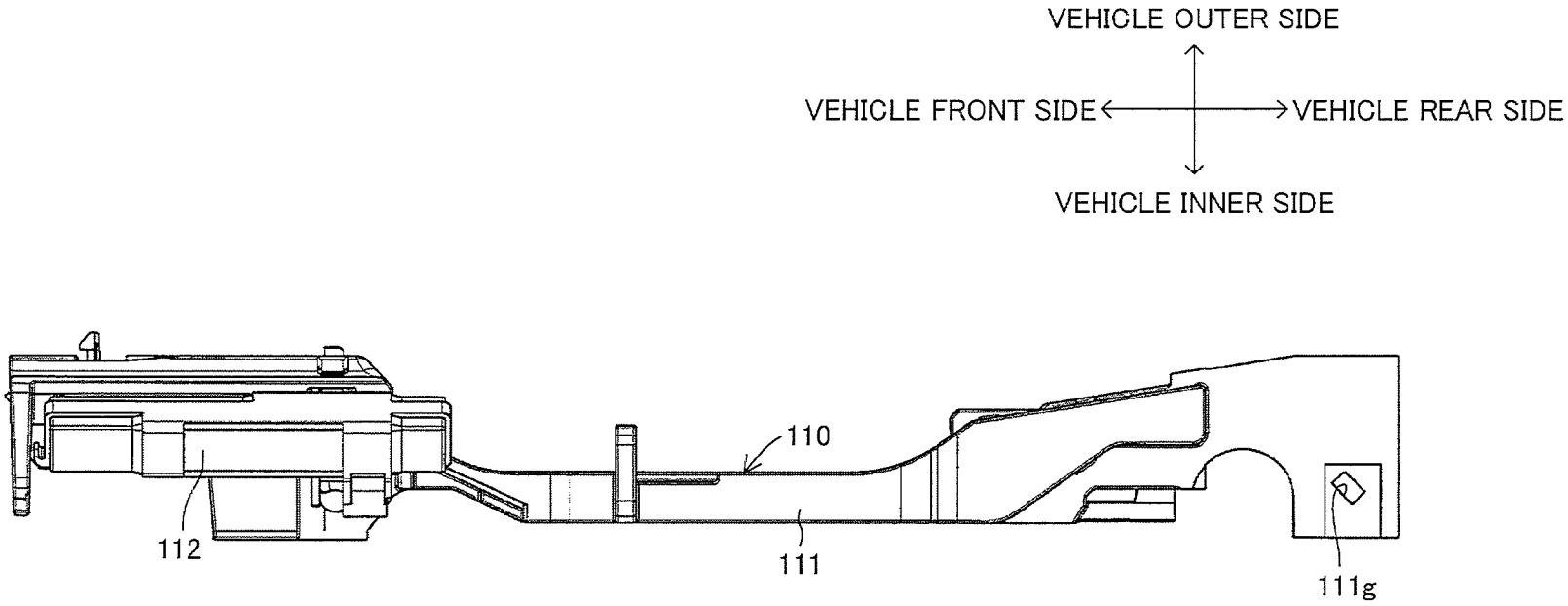
FIG. 9 is a bottom view of the base assembly illustrated in FIG. 8.
Figure 10:
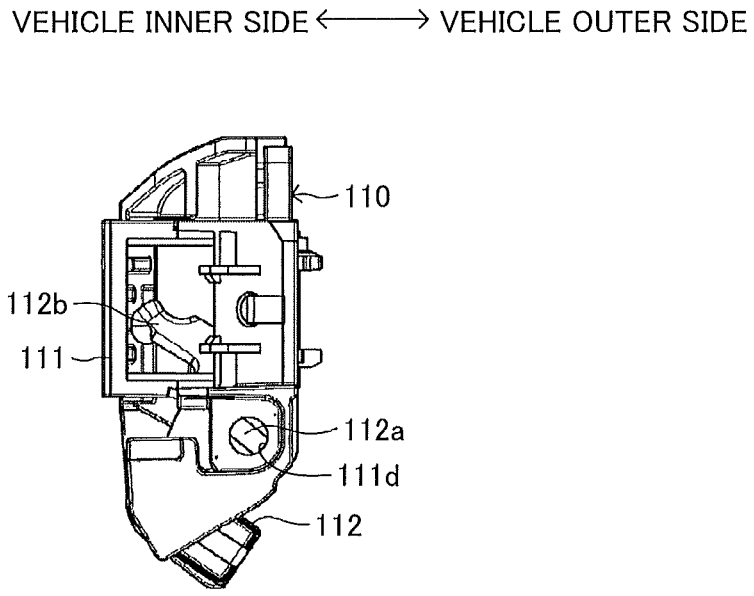
FIG. 10 is a front view of the base assembly illustrated in FIG. 8.
Figure 11:
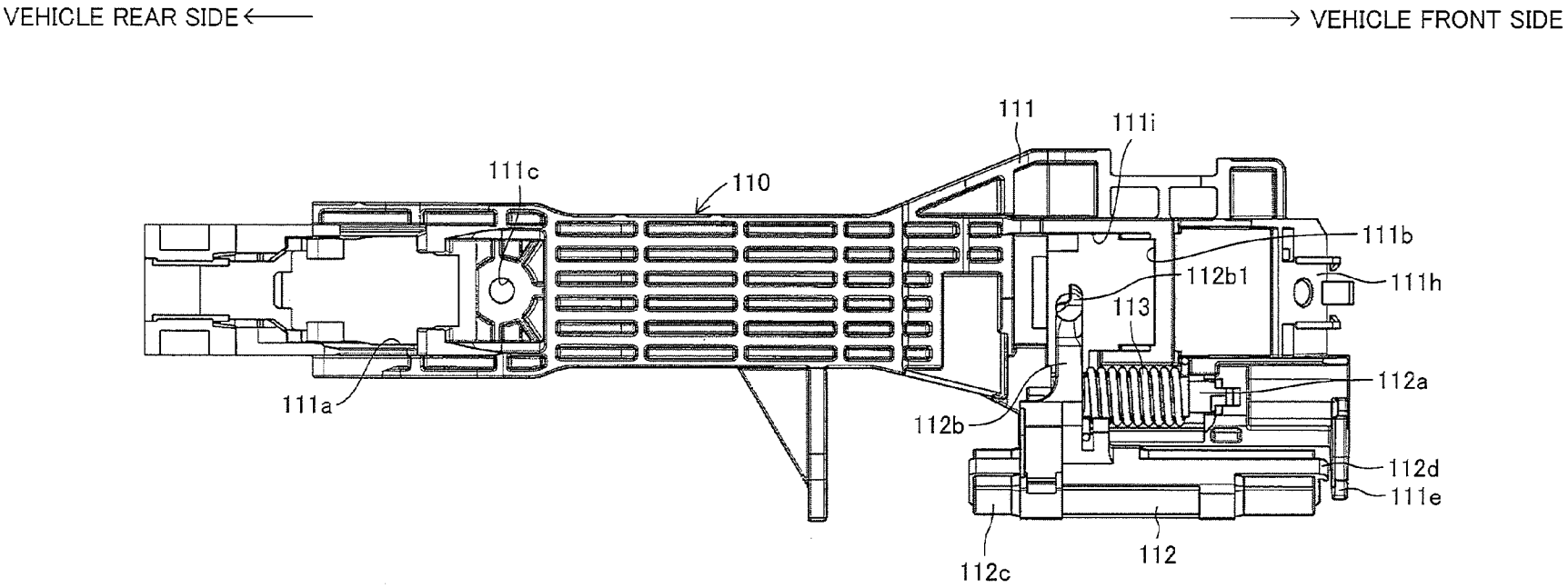
FIG. 11 is a rear view of the base assembly illustrated in FIG. 8.
Figure 12:
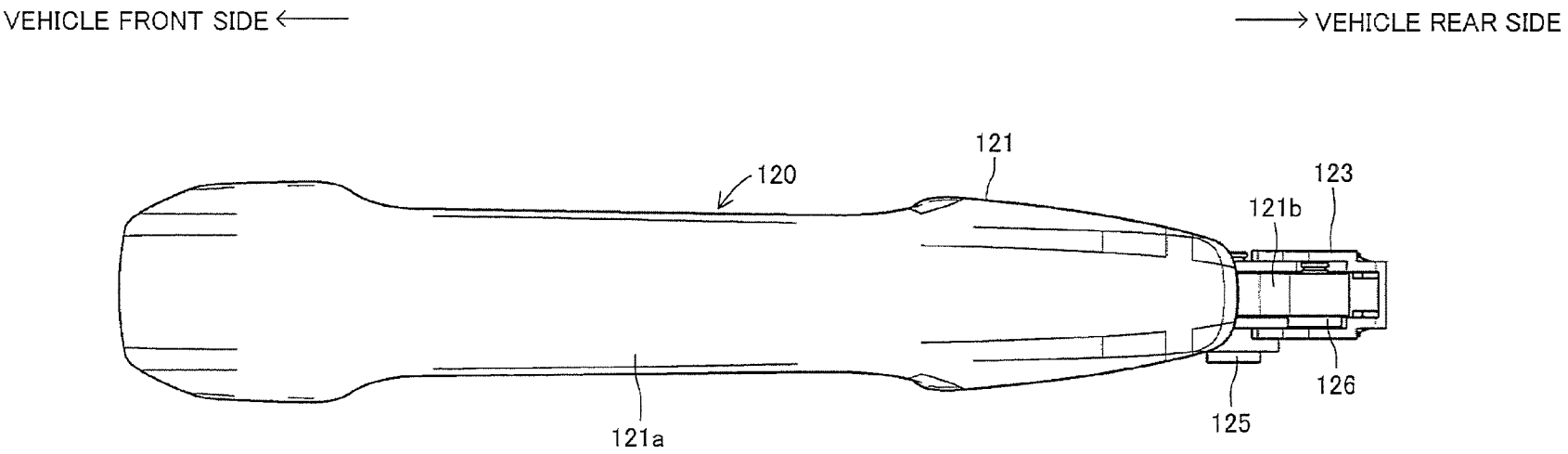
FIG. 12 is a side view of a handle assembly in the door handle device for a vehicle illustrated in FIG. 2.

The connecting link 122 serves to connect the hand grip 121 and the link base 123 to each other as illustrated in detail in FIG. 7. The connecting link 122 is rotatably mounted, at a base end portion **122*a* thereof, to the link base 123 with a connecting pin 125 to be swingable in the vehicle front-rear direction (in a right and left direction in FIGS. 6 and 7). Further, the connecting link 122 is rotatably mounted, at a distal end portion 122*b* thereof, to the leg portion 121*b* of the hand grip 121 with a connecting pin 126. Note that, a stopper 122*b*1 for restricting a maximum rotation amount of the hand grip 121 relative to the connecting link 122 is arranged at the distal end portion 122*b* of the connecting link 122. This stopper 122*b*1 is engageable with an engagement portion 121*b*1 arranged at the leg portion 121*b* of the hand grip 121**.

Figure 20:
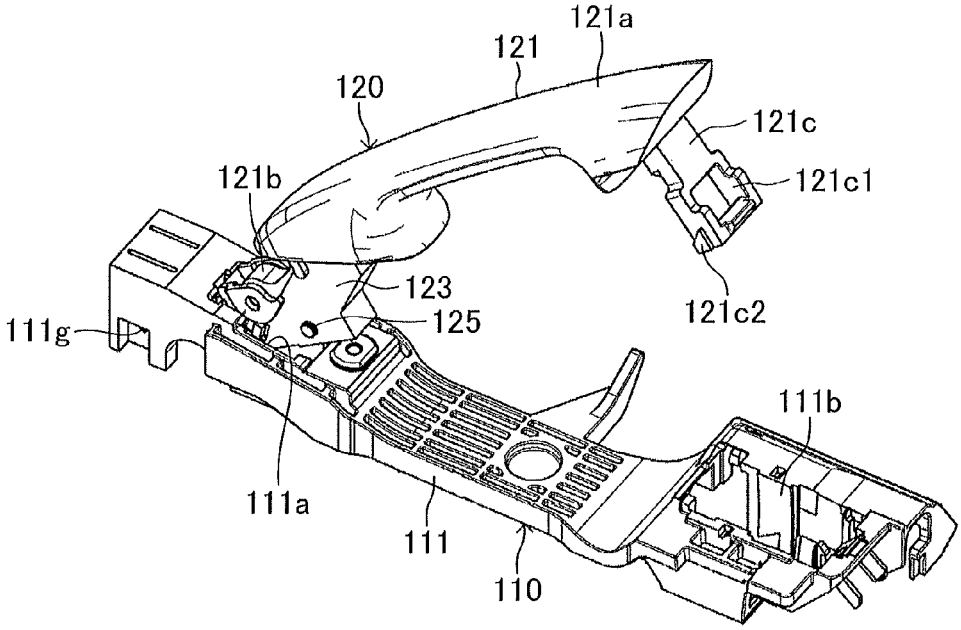
FIG. 20 is a perspective view illustrating a state of assembling the handle assembly illustrated in FIGS. 12 to 15 to the base assembly illustrated in FIGS. 8 to 11.
Figure 21:
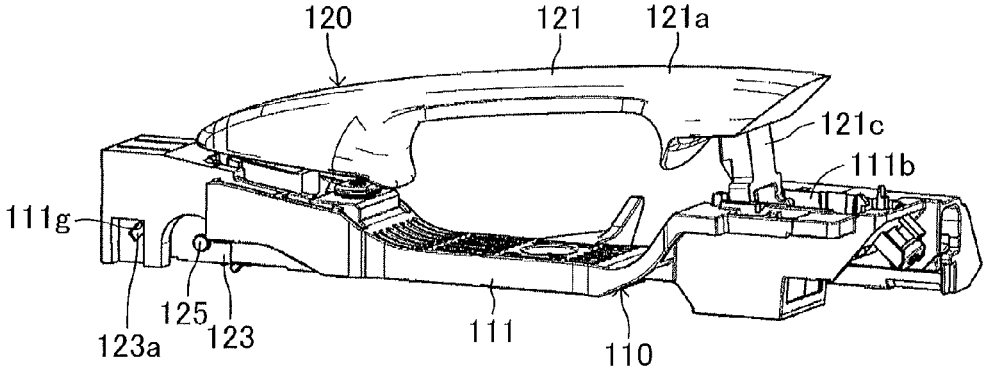
FIG. 21 is a perspective view illustrating a state in which the handle assembly illustrated in FIGS. 12 to 15 is assembled to the base assembly illustrated in FIGS. 8 to 11.

The link base 123 serves to mount (fix) the base end portion **122*a* of the connecting link 122 to the one end portion (vehicle rear end portion) of the frame 111. The link base 123 is mounted together with the connecting link 122 to the leg portion 121*b* of the hand grip 121 and is elastically mounted, at a pair of tongue piece portions 123*a*, to a pair of rectangular mounting holes 111*g* formed in the one end portion of the frame 111. Note that, as illustrated in FIG. 20, mounting of the link base 123 to the frame 111 is performed by mounting the link base 123 of the handle assembly 120 to the frame 111 through the rear opening 111*a* of the vehicle rear portion arranged at the frame 111**.

The spring 124 is a second biasing member for biasing the connecting link 122 to an initial position (position illustrated in FIGS. 6 and 7) relative to the link base 123. When the connecting link 122 is in the initial position, the connecting link 122 is held in abutment against a stopper portion **123*b* of the link base 123. In addition, the spring 124 is rotatably mounted, at a coil portion 124*a*, on a cylindrical portion 122*a*1 formed at the base end portion 122*a* of the connecting link 122, and one end portion 124*b* of the spring 124 is elastically engaged with the connecting link 122 while another end portion 124*c* of the spring 124 is elastically engaged with the link base 123. Therefore, the spring 124 biases the connecting link 122 so as to rotate the connecting link 122 in a counterclockwise rotation direction in FIGS. 6 and 7**.

Figure 36:
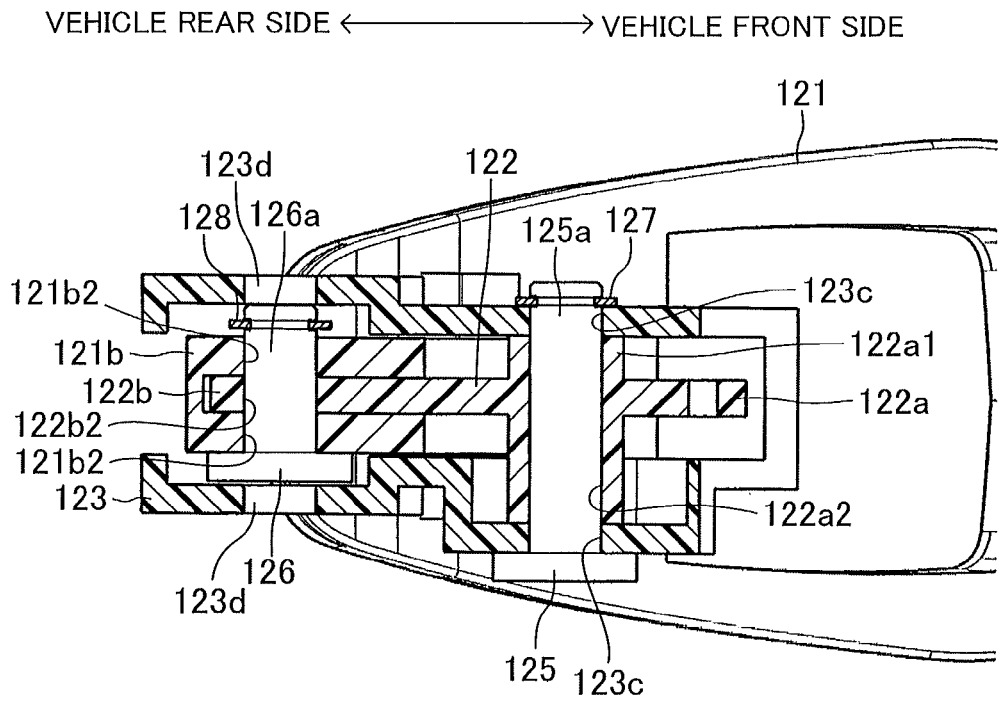
FIG. 36 is a cross-sectional view illustrating a relation among the hand grip, a connecting link, a link base, two connecting pins, and the like in the handle assembly illustrated in FIGS. 12 to 15.

As illustrated in FIG. 36, the connecting pin 125 (first connecting pin) is inserted into a pair of mounting holes **123*c*, 123*c* formed at a vehicle front portion of the link base 123. In addition, the connecting pin 125 includes a shaft portion 125*a* inserted into a mounting hole 122*a*2 formed in the base end portion 122*a* of the connecting link 122, and the connecting pin 125 is prevented from loosening from the mounting hole 122*a*2 by a clip 127 mounted to this shaft portion 125*a*. As illustrated in FIG. 36, the connecting pin 126 (second connecting pin) is inserted into a pair of mounting holes 121*b*2, 121*b*2 formed in the leg portion 121*b* of the hand grip 121. In addition, the connecting pin 126 includes a shaft portion 126*a* inserted into a mounting hole 122*b*2 formed in the distal end portion 122*b* of the connecting link 122, and the connecting pin 126 is prevented from loosening from the mounting hole 122*b*2 by a clip 128 mounted to this shaft portion 126*a*. Therefore, the base end portion 122*a* of the connecting link 122 is rotatably mounted to the vehicle front portion of the link base 123 with the connecting pin 125. Further, the leg portion 121*b* of the hand grip 121 is rotatably mounted to the distal end portion 122*b* of the connecting link 122 with the connecting pin 126**.

Figure 37:
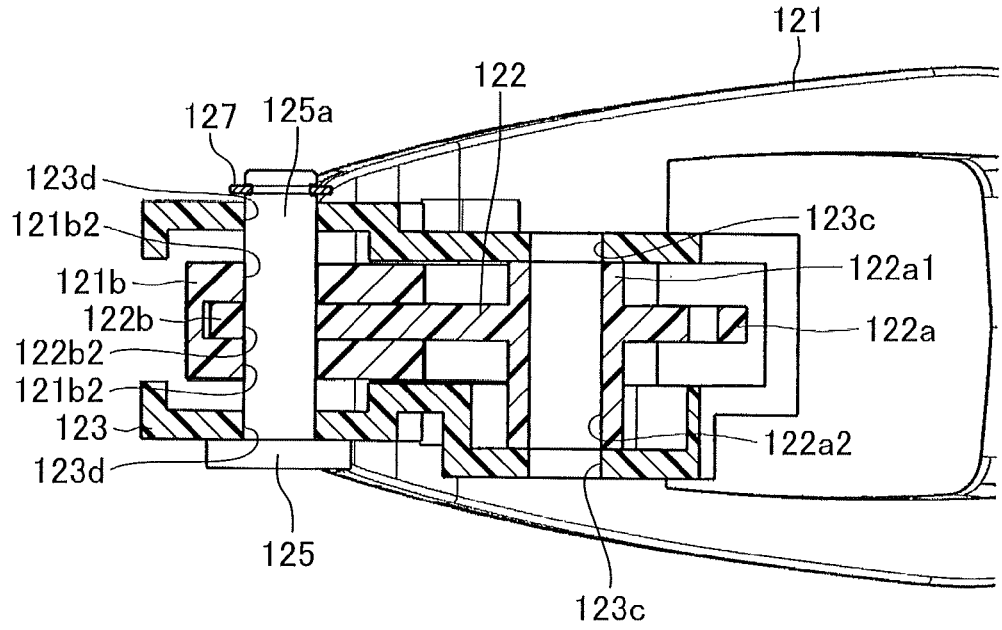
FIG. 37 is a cross-sectional view of a unidirectional door handle device realized by connecting the hand grip, the connecting link, and the link base with one connecting pin in a bi-directional door handle device illustrated in FIG. 36.

The shaft portions **125*a*, 126*a* of the connecting pins 125, 126 are formed to have the same diameter and the mounting holes 121*b*2, 122*a*2, 122*b*2, 123*c* are formed to have the same diameter. In addition, each of the mounting holes 121*b*2, 122*b*2 is provided coaxially with a pair of mounting holes 123*d*, 123*d* formed in a vehicle rear portion of the link base 123 when the connecting link 122 is in the initial position. Each of the mounting holes 123*d*, 123*d* is formed to have the same diameter as the diameter of each of the mounting holes 121*b*2, 122*a*2, 122*b*2, 123*c*. Therefore, as illustrated in FIG. 37, the connecting pin 125 can be inserted into each of the mounting holes 121*b*2, 122*b*2, 123*d* and prevented from loosening therefrom by the clip 127. Through use of the connecting pin 125, the distal end portion 122*b* of the connecting link 122 and the link base 123 are configured to be integrally connectable to each other and the leg portion 121*b* of the hand grip 121 is configured to be rotatable relative to the distal end portion 122*b* of the connecting link 122 and the link base 123**.

As illustrated in FIGS. 2 to 6 and FIGS. 16 to 19, the cap assembly 130 includes a cap 131, the lever 132, an inertia stopper 133, a spring 134, and the like. The cap 131 is configured to be mounted to a front end portion **111*h* of the frame 111 with a screw 135 from the vehicle outer side in a state in which the outer panel 200*a* of the slide door 200 is sandwiched between the frame 111 and the cap 131. Further, the cap 131 includes a support portion 131*a* for supporting the lever 132 and the inertia stopper 133. Note that, the screw 135 is configured to be threadingly engaged with a nut 136 (see an imaginary line in FIG. 6) integrally arranged at the cap 131**.

The lever 132 serves to transmit the door opening operation of the hand grip 121 to the input portion **112*b* of the bell crank 112 at a distal end portion 132*a*. The lever 132 is rotatably mounted to the support portion 131*a* of the cap 131 at a base end portion 132*b* with a pin 137. Further, the lever 132 is slidably engaged with the arm portion 121*c* of the hand grip 121 at an intermediate portion 132*c*. Note that, a protrusion 132*b*1 is formed at the base end portion 132*b* of the lever 132, and this protrusion 132*b*1 is configured to be held in abutment against a stopper portion 131*a*1, which is formed at the support portion 131***a* of the cap 131, when the lever 132 is in an initial position illustrated in FIG. 6.

Figure 34:
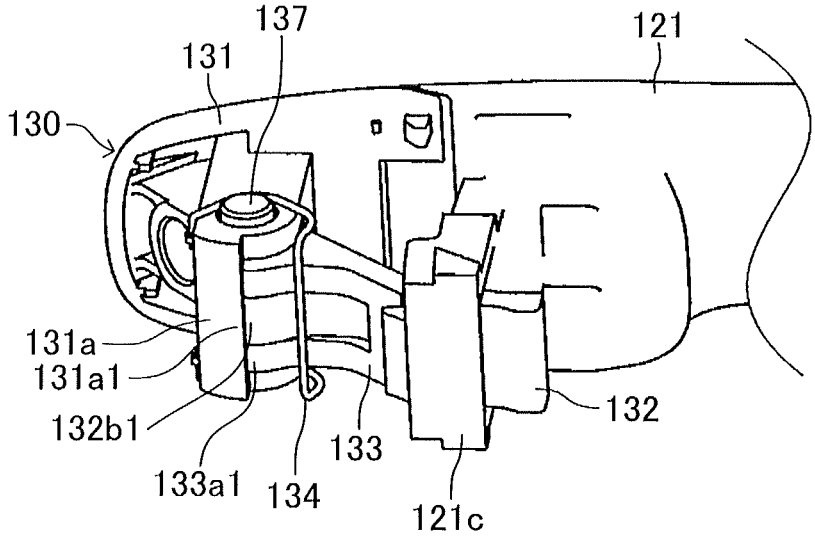
FIG. 34 is a perspective view of a state in which the closing operation of the hand grip illustrated in FIG. 30 is prevented by an inertia stopper of the cap assembly.
Figure 35:
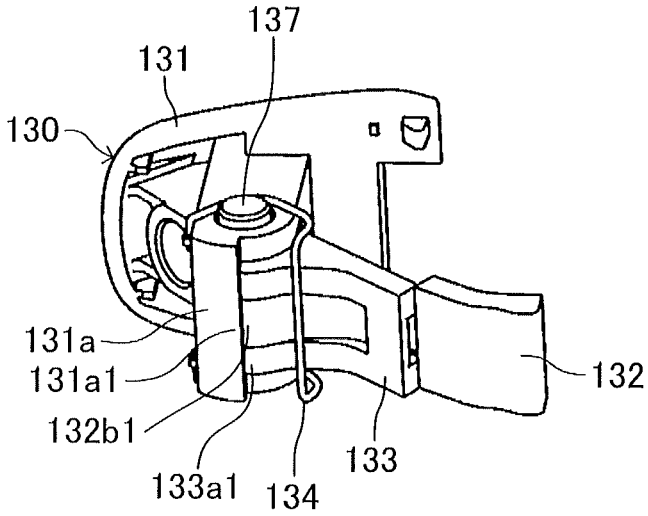
FIG. 35 is a perspective view of a state in which the hand grip is removed from FIG. 34.

The inertia stopper 133 serves to restrict the movement of the hand grip 121 in the door closing direction, for example, when a predetermined inertia acts in the door closing direction of the slide door 200 due to collision of the vehicle or the like. The inertia stopper 133 is rotatably mounted together with the lever 132 to the support portion 131*a* of the cap 131 at a base end portion 133*a* with the pin 137. Further, the inertia stopper 133 is contactable to the lever 132 as illustrated in FIGS. 16 to 19 and FIGS. 30 to 33 and is separable from the lever 132 as illustrated in FIGS. 34 and 35. Therefore, the inertia stopper 133 is separated from the lever 132 to be tiltable by a predetermined amount as illustrated in FIGS. 34 and 35 when the predetermined inertia acts in the door closing direction of the slide door 200 as described above. At this time, a protrusion 133*a*1 formed at the base end portion 133*a* is held in abutment against the stopper portion 131*a*1 formed at the support portion 131*a* of the cap 131.

The spring 134 is a third biasing member for biasing the inertia stopper 133 in an initial position (position illustrated in FIGS. 16 to 19 and FIGS. 30 to 33) relative to the lever 132. When the lever 132 is in the initial position, the inertia stopper 133 is integrally connected to the lever 132, and the arm portion 121*c* of the hand grip 121 is slidably engaged with the lever 132 and the inertia stopper 133 in the vehicle front-rear direction (see FIGS. 30 and 32). Further, the spring 134 is mounted to the support portion 131*a* of the cap 131 at both end portions 134*a*, 134*b*, and an intermediate portion 134*c* of the spring 134 is elastically engaged with an intermediate portion 133*b* of the inertia stopper 133, thereby biasing the inertia stopper 133 to rotate the inertia stopper 133 in a counterclockwise direction of FIG. 17.

The closing operation switch S1 operates in accordance with the door closing operation of the hand grip 121 (operation of the hand grip 121 moving from the initial position indicated by the solid lines to a position indicated by the two-dot chain lines) as illustrated in FIGS. 28 and 29. The closing operation switch S1 is mounted to the frame 111 and can electrically detect movement of the connecting link 122 from an initial position indicated by the solid lines to a closing operation position indicated by the two-dot chain lines. An electrical detection signal of this closing operation switch S1 is configured to be input to an electrical control unit ECU illustrated in FIG. 1, and an actuator Act mounted adjacent to the fully opened lock 203 is configured to operate based on this detection signal so that a release operation of the fully opened lock 203 is performed. Note that, when the release operation of the fully opened lock 203 is performed, the slide door 200 retained and locked in the fully opened state by the fully opened lock 203 is released and the slide door 200 in the fully opened state can be operated in the door closing direction (the slide door 200 can be moved in the vehicle front-rear direction).

In the door handle device 100 for a vehicle configured as describe above, the base assembly 110, the handle assembly 120, the cap assembly 130, and the like are respectively assembled in advance. The base assembly 110, the handle assembly 120, the cap assembly 130, and the like are assembled to the slide door 200 through the following assembling procedure. First, the frame 111 of the base assembly 110 is assembled to the outer panel 200*a* of the slide door 200 from the door inner side. Next, as illustrated in FIGS. 20 to 24, the handle assembly 120 is mounted to the frame 111 of the base assembly 110.

Next, the cap assembly 130 is mounted to the hand grip 121 of the handle assembly 120 and the frame 111 of the base assembly 110. Finally, the output portion 112*c* of the bell crank 112 of the base assembly 110 is mechanically linked, through an intermediation of the link mechanism (not shown), to the front lock 201 and the rear lock 202 that are mounted to the slide door 200, and the closing operation switch S1 mounted to the frame 111 of the base assembly 110 and the actuator Act mounted adjacent to the fully opened lock 203 are electrically connected to each other.

Meanwhile, when mounting the handle assembly 120 to the frame 111 of the base assembly 110 as described above, the leg portion 121*b* of the hand grip 121 is mounted to the vehicle rear end portion (one end portion) of the frame 111 together with the connecting link 122, the link base 123, and the like through an opening (not shown), which is formed in the outer panel 200*a* of the slide door 200, and through the rear opening 111*a* of the frame 111, and the arm portion 121*c* of the hand grip 121 is inserted into a vehicle front end portion (other end portion) of the frame 111 through an opening (not shown), which is formed in the outer panel 200*a* of the slide door 200, and through the front opening 111*b* of the frame 111.

Figure 22:
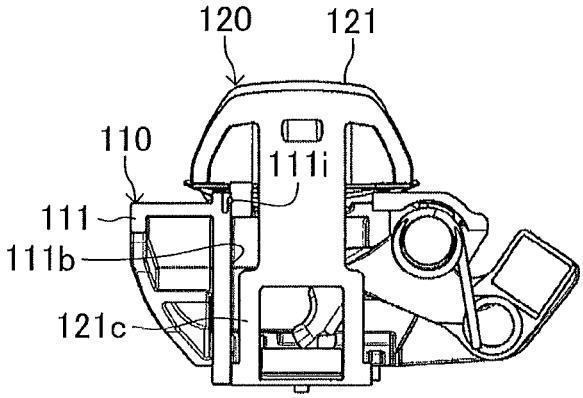
FIG. 22 is a cross-sectional view illustrating a relation between a frame and a hand grip in a state in which the handle assembly is assembled to the base assembly.
Figure 23:
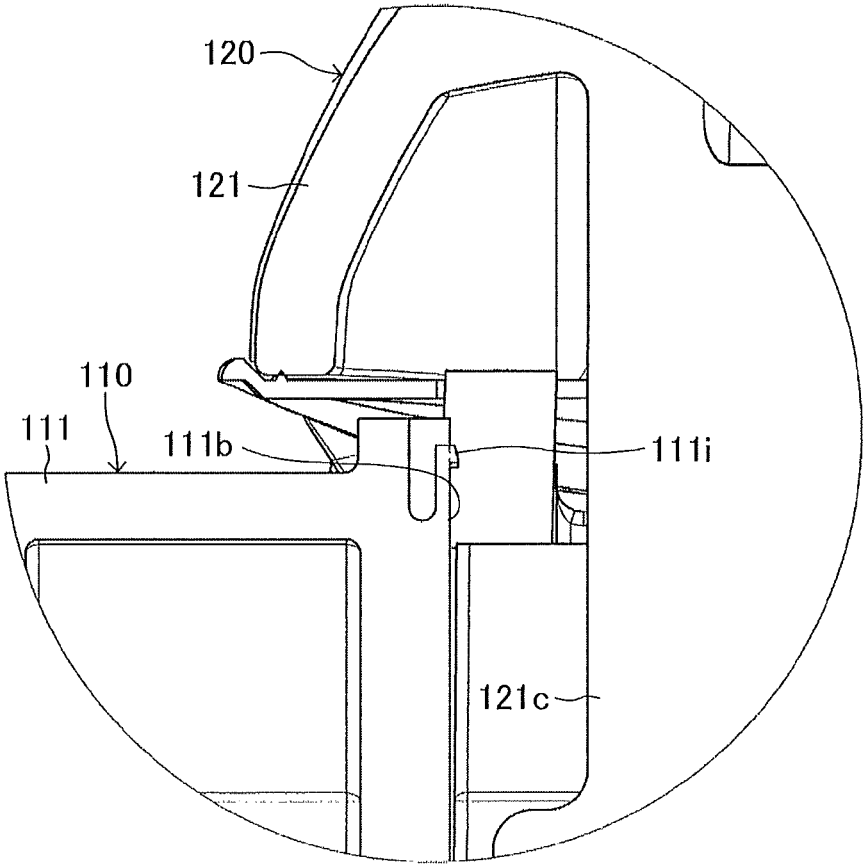
FIG. 23 is a partial enlarged view of FIG. 22.
Figure 24:
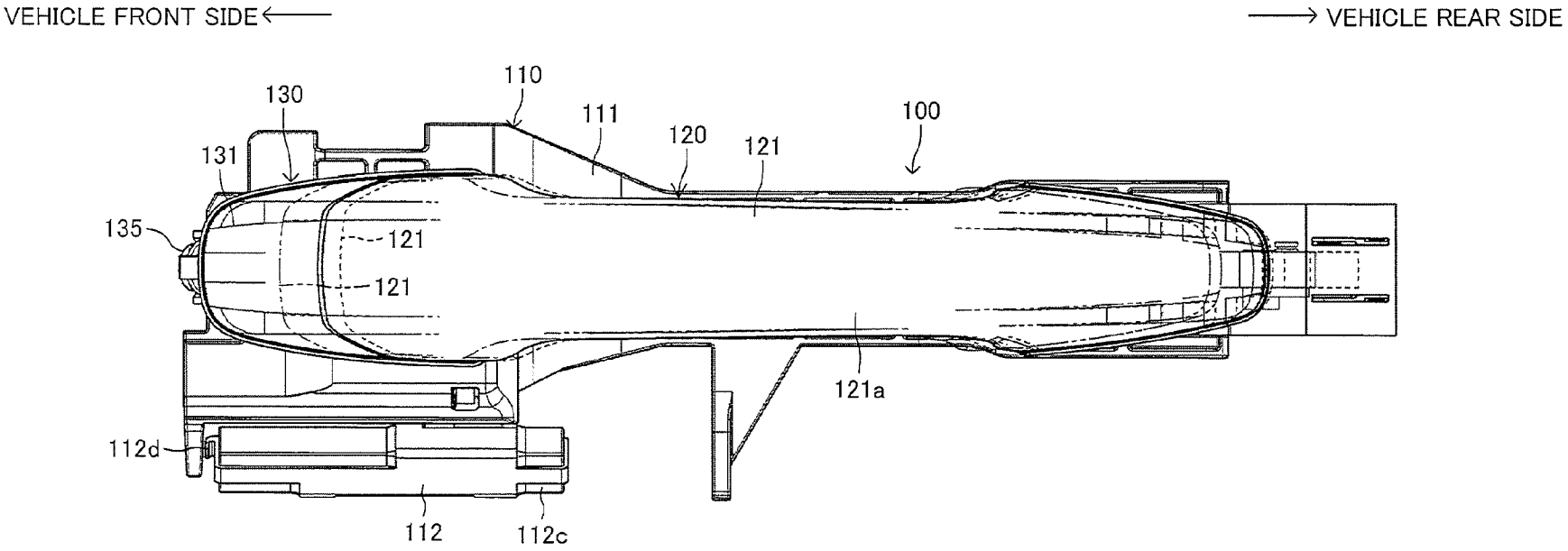
FIG. 24 is a side view illustrating door opening and closing operations of the door handle device for a vehicle illustrated in FIGS. 2 to 7 as indicated by the dashed lines and the two-dot chain lines.
Figure 25:
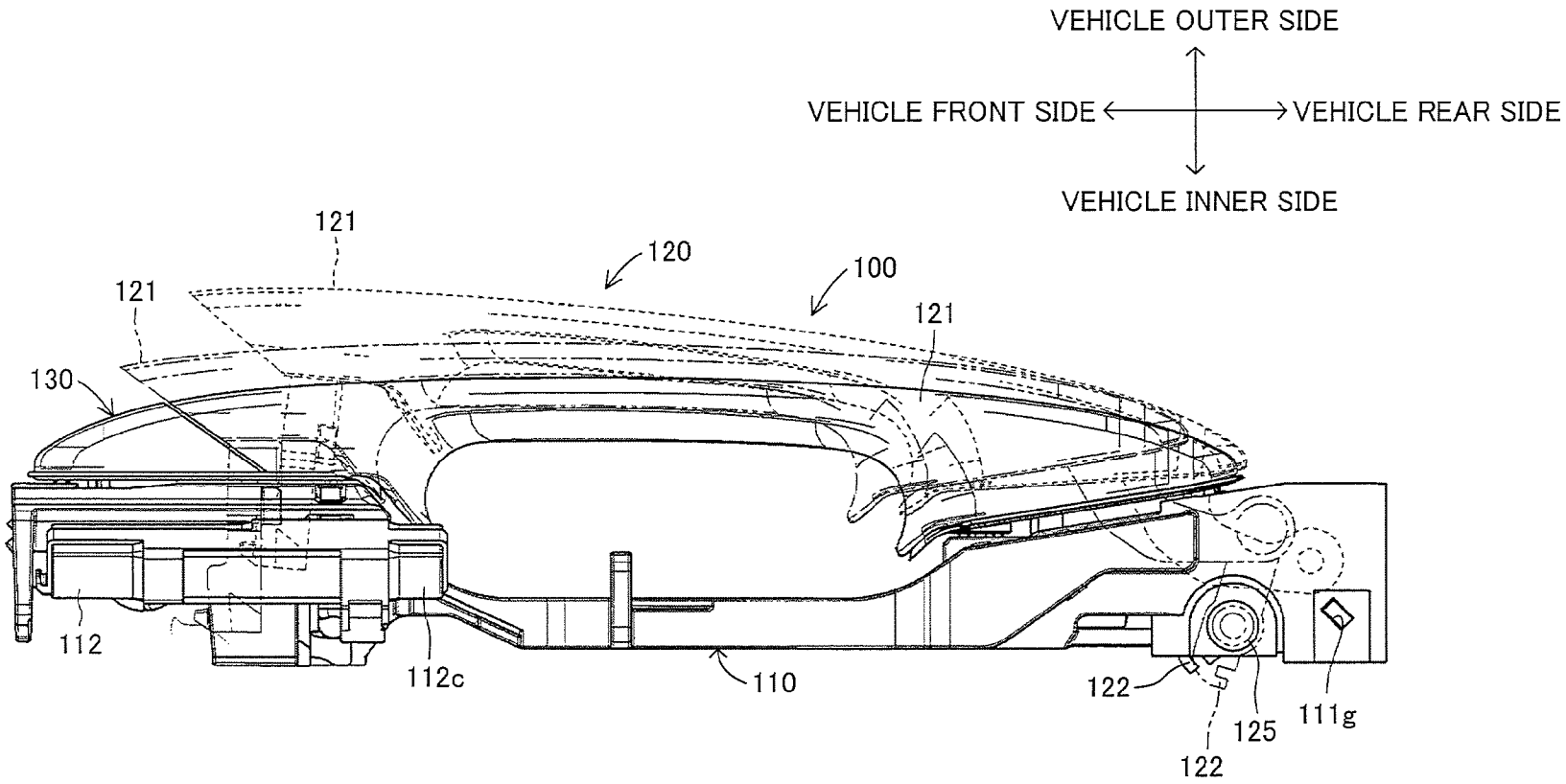
FIG. 25 is a bottom view of the door handle device for a vehicle illustrated in FIG. 24.
Figure 26:
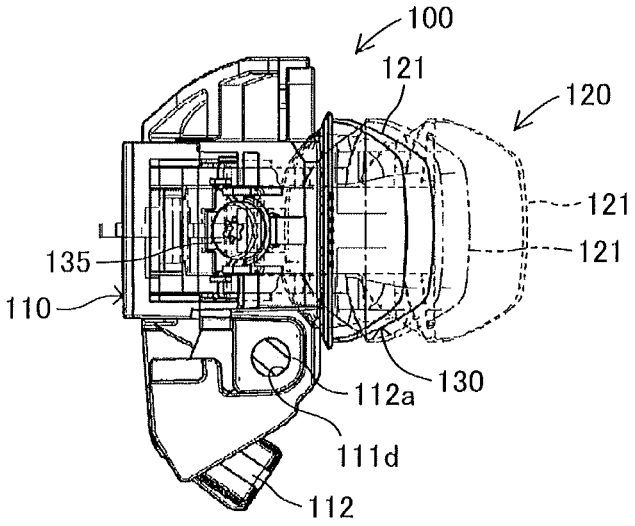
FIG. 26 is a front view of the door handle device for a vehicle illustrated in FIG. 24.
Figure 27:
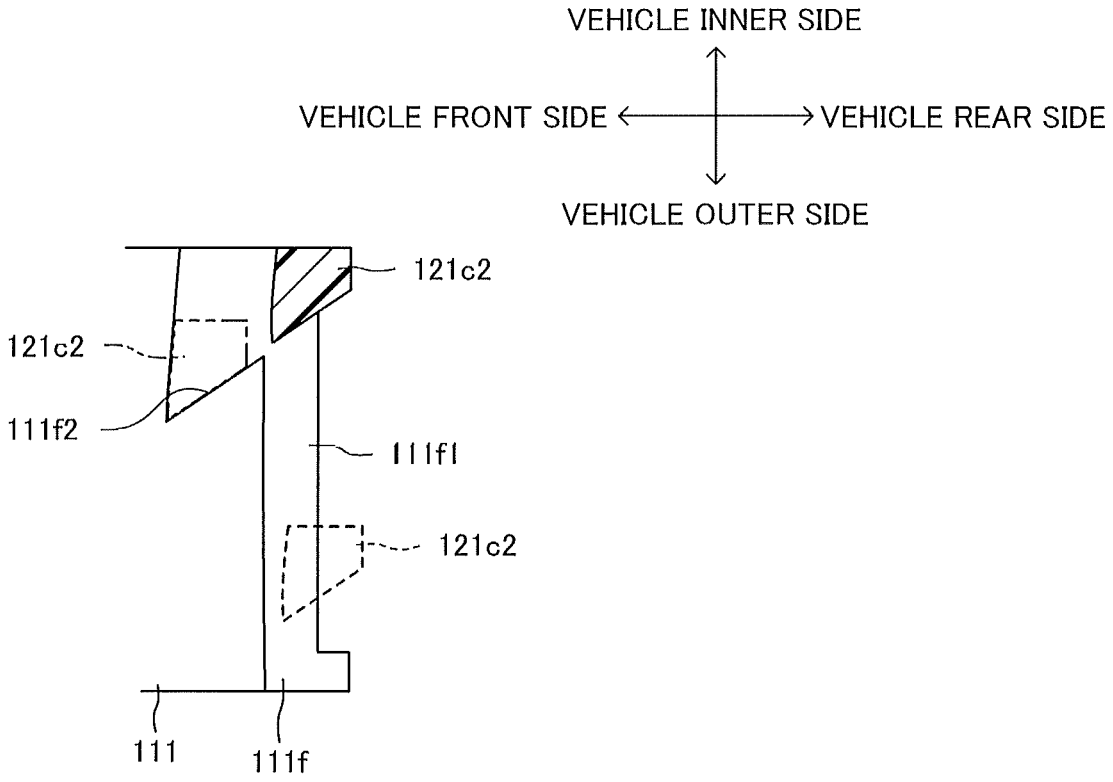
FIG. 27 is a cross-sectional plan view taken transversely along the center line of the door handle device for a vehicle, for schematically illustrating a relation between a guide of the frame and a protrusion of the hand grip in the door handle device for a vehicle illustrated in FIG. 24.

Note that, in such a state (state in which the handle assembly 120 is mounted to the frame 111 of the base assembly 110), the pair of tongue piece portions 123*a* arranged at the link base 123 is elastically mounted to the pair of rectangular mounting holes 111*g* formed in the frame 111. In this manner, the leg portion 121*b* of the hand grip 121 is prevented from loosening from the frame 111. Further, in such a state, the arm portion 121*c* of the hand grip 121 is mounted to the frame 111 as illustrated in FIGS. 22 and 23 while pressing and expanding an anti-loosening protrusion 111*i* arranged at the frame 111. In this manner, the arm portion 121*c* of the hand grip 121 is prevented from loosening from the frame 111 (is temporarily locked).

Further, when mounting the cap assembly 130 to the hand grip 121 of the handle assembly 120 and the frame 111 of the base assembly 110 as described above, the bell crank 112 is retained in the temporary retaining position in the base assembly 110 relative to the frame 111. Therefore, when mounting the cap assembly 130, firstly, the hand grip 121 of the handle assembly 120, which is mounted to the frame 111, is rotated toward the vehicle outer side by a predetermined amount. In such a state, the distal end portion 132*a* of the lever 132 of the cap assembly 130 is inserted into the insertion hole 121*c*1 arranged at the arm portion 121*c* of the hand grip 121. Next, the cap 131 of the cap assembly 130 is fixed to the frame 111. After that, the hand grip 121 is rotated toward the vehicle outer side at a full stroke, and the bell crank 112 retained and locked in the temporary retaining position is released therefrom through an intermediation of the lever 132. Therefore, the spring 113 mounted at the frame 111 exerts a predetermined function. This operation to release the bell crank 112 from the temporary retaining position is substantially the same as that disclosed in JP 2003-41811 A.

Further, in a state in which the output portion 112*c* of the bell crank 112 is mechanically linked to the front lock 201 and the rear lock 202 and the closing operation switch S1 mounted to the frame 111 is electrically connected to the actuator Act mounted adjacent to the fully opened lock 203, an operation force (force corresponding to an operation force of the hand grip 121) for releasing retaining and locking of the front lock 201 and the rear lock 202 through the door opening operation of the hand grip 121 is generated, and therefore the slide door 200 can be opened. In addition, an operation force (electrical release force triggered by and obtained from the operation force of the hand grip 121) for releasing retaining and locking of the fully opened lock 203 through the door closing operation of the hand grip 121 is generated, and therefore the slide door 200 can be closed. Note that, a drive force to open or close the slide door 200 (drive force for moving the slide door 200 in the vehicle front-rear direction) may be a manual operation force or an electrical drive force.

In the first embodiment configured as described above, when the hand grip 121 is moved through the door opening operation in the same direction as the door opening direction to move the slide door 200 in the fully closed state to the opened position, the operation force for releasing the front lock 201 and the rear lock 202 (fully closed latch mechanism), which retain and lock the slide door 200 in the fully closed state, is generated. Further, when the hand grip 121 is moved through the door closing operation in the same direction as the door closing direction to move the slide door 200 in the fully opened state to the closed position, the operation force for releasing the fully opened lock 203 (fully opened latch mechanism), which retains and locks the slide door 200 in the fully opened state, is generated. Therefore, retaining and locking of the front lock 201 and the rear lock 202 or retaining and locking of the fully opened lock 203 can be released through the operation of the hand grip 121 in a consistent direction (same direction) to the opening or closing direction of the slide door 200. In this manner, the slide door 200 can be opened or closed. Thus, the door handle device 100 for a vehicle is superior in operability.

Further, in the first embodiment, the base assembly 110, the handle assembly 120, the cap assembly 130, and the like are respectively assembled in advance, and the base assembly 110, the handle assembly 120, the cap assembly 130, and the like are assembled to the slide door 200 through the above-mentioned assembling procedure. Meanwhile, the above-mentioned assembling procedure is an assembling procedure similar to a general conventional assembling procedure for the door handle device for a vehicle to which the present invention is applied. After assembling the frame 111 to the outer panel 200*a* of the slide door 200, the link base 123, the connecting link 122, and the hand grip 121 are mounted to the frame 111. Next, the lever 132 and the cap 131 are mounted to the hand grip 121 and the frame 111, thereby assembling each component member (frame 111, link base 123, connecting link 122, hand grip 121, lever 132, respective springs 113, 124, and the like) to the outer panel 200*a*. As a result, the door handle device 100 for a vehicle is superior in assemblability.

Further, in the first embodiment, the movement of the hand grip 121 operated in the same direction as the door opening direction to move the slide door 200 in the fully closed state to the opened position involves the movement of the hand grip 121 from the initial position in the door opening direction against the biasing force of the spring 113, the tilt of the lever 132 toward the vehicle outer side, and the movement of the protrusion 121*c*2, which is arranged at the arm portion 121*c*, along the first guide groove 111*f*1, which is arranged at the frame 111, in the door opening direction of the slide door 200. Further, the movement of the hand grip 121 operated in the same direction as the door opening direction involves the tilt of the hand grip 121 about a connection center (connecting pin 126) between the leg portion 121*b* of the hand grip 121 and the connecting link 122 toward a door opened position at the vehicle outer side. Here, when the hand grip 121 is operated in the same direction as the door opening direction to move the slide door 200 in the fully closed state to the opened position, the connecting pin 126 may move to the vehicle rear side and the vehicle inner side but the connecting link 122 is restricted by the stopper portion 123*b*. As a result, the hand grip 121 tilts about the connecting pin 126. Note that, the movement of the hand grip 121 in this case is restricted through abutment of the engagement portion 121*b*1 of the hand grip 121 against the stopper 122*b*1 of the connecting link 122.

Moreover, the movement of the hand grip 121 operated in the same direction as the door closing direction to move the slide door 200 in the fully opened state to the closed position involves the movement of the hand grip 121 and the connecting link 122 from the initial positions in the door closing direction against a biasing force of the spring 124, the swing of the connecting link 122 in the door closing direction of the slide door 200, and the movement of the protrusion 121*c*2, which is arranged at the arm portion 121*c*, along the second guide groove 111*f*2, which is arranged at the frame 111, in the door closing direction of the slide door 200. Further, the movement of the hand grip 121 operated in the same direction as the door closing direction involves the movement of a connection portion between the leg portion 121*b* of the hand grip 121 and the connecting link 122 in the door closing direction. In accordance with such movement of the hand grip 121, the connecting link 122 swings about a connection center between the connecting link 122 and the link base 123 in the door closing direction of the slide door 200. Note that, the movement of the hand grip 121 in this case is restricted through abutment of the protrusion 121*c*2 of the hand grip 121 against a front end wall of the second guide groove 111*f*2 arranged at the frame 111. Alternatively, the movement of the hand grip 121 in this case may be restricted through abutment of the engagement portion 121*b*1 against the stopper 122*b*1. Further, the movement of the hand grip 121 may be restricted through the abutment of the protrusion 121*c*2 of the hand grip 121 against the front end wall of the second guide groove 111*f*2 arranged at the frame 111 and the abutment of the engagement portion 121*b*1 against the stopper 122*b*1.

Thus, a movement amount of the hand grip 121 when the slide door 200 is moved to the opened position (i.e., a tilt amount of the hand grip 121 about the connection center between the leg portion 121*b* of the hand grip 121 and the connecting link 122 toward the door opened position at the vehicle outer side) can be necessarily sufficiently secured (for this purpose, a timing at which the engagement portion 121*b*1 of the hand grip 121 is brought into abutment against the stopper 122*b*1 of the connecting link 122 needs to be changed). In addition, a movement amount of the hand grip 121 when the slide door 200 is moved to the closed position (i.e., a swing amount of the connecting link 122 about the connection center between the connecting link 122 and the link base 123 in the door closing direction) can be necessarily sufficiently secured (for this purpose, a timing at which the protrusion 121*c*2 of the hand grip 121 is brought into abutment against the front end wall of the second guide groove 111*f*2 arranged at the frame 111 needs to be changed). Therefore, each operation of the hand grip 121 can be appropriately performed.

Further, in the first embodiment, the inertia stopper 133, which is separated from the lever 132 against the biasing force of the spring 134 to be tiltable by the predetermined amount when the predetermined inertia acts in the door closing direction of the slide door 200, is arranged at the lever 132. When this inertia stopper 133 is separated from the lever 132 to tilt by the predetermined amount, the arm portion 121*c* of the hand grip 121 is engaged with the inertia stopper 133 to restrict the hand grip 121 from moving in the door closing direction.

Accordingly, in the vehicle in which the slide door 200 is in the fully opened state, when the predetermined inertia acts in the door closing direction of the slide door 200 due to collision of the vehicle or the like, the inertia stopper 133 can be separated from the lever 132 to tilt by the predetermined amount. Therefore, the arm portion 121*c* of the hand grip 121 is engaged with the inertia stopper 133 to restrict the hand grip 121 from moving in the door closing direction. Consequently, even when the above-mentioned inertia acts on the device, the hand grip 121 is not moved in the door closing direction by the inertia, and the operation force for releasing the fully opened lock 203, which retains and locks the slide door 200 in the fully opened state, is not generated. As a result, a measure against the inertia due to the above-mentioned collision of the vehicle or the like (safety improvement so as not to generate the operation force for releasing retaining and locking of the fully opened latch mechanism) can be taken by a simple configuration (configuration in which the inertia stopper 133 and the spring 134 are arranged at the lever 132).

Further, in the door handle device 100 for a vehicle of the first embodiment, the hand grip 121 is operable in the door opening direction of the slide door 200 (in the vehicle rearward direction) and the hand grip 121 is operable in the door closing direction of the slide door 200 (in the vehicle forward direction). Therefore, the door handle device 100 for a vehicle is a bi-directional door handle device. Meanwhile, in the door handle device 100 for a vehicle of this embodiment, as illustrated in FIG. 37, through use of the connecting pin 125, the distal end portion 122*b* of the connecting link 122 and the link base 123 are integrally connectable to each other and the leg portion 121*b* of the hand grip 121 is rotatable relative to those components (distal end portion 122*b* of the connecting link 122 and link base 123).

Accordingly, the connecting link 122 can be configured so as not to swing in the door closing direction of the slide door 200 (in the vehicle forward direction) and the hand grip 121 can be prevented from operating in the door closing direction of the slide door 200 (i.e., the connecting link 122 is configured so as not to swing and the hand grip 121 is operable in only one direction). Therefore, the device can be configured as a unidirectional door handle device. As a result, in the door handle device 100 for a vehicle of this embodiment, in a case where the device is configured as a unidirectional door handle device, the link base 123, the connecting link 122, the hand grip 121, and the like can be applied as common components, and hence costs can be reduced through common application of components. Note that, in a case where the device is configured as a unidirectional door handle device, the connecting link 122 may be replaced by a bush.

Note that, in a unidirectional door handle device, an operation to operate the hand grip 121 in one direction in a state in which the slide door 200 is closed is the door opening operation of the slide door 200. Further, an operation to operate the hand grip 121 in one direction in a state in which the slide door 200 is opened is the door closing operation of the slide door 200. Therefore, the unidirectional door handle device is configured so that the hand grip 121 is operated in one direction to generate operation forces, for example, for releasing both the fully closed latch mechanism, which retains and locks the slide door 200 in the fully closed state, and the fully opened latch mechanism, which retains and locks the slide door 200 in the fully opened state.

Moreover, in the door handle device 100 for a vehicle of the first embodiment, as illustrated in FIG. 36, the base end portion 122*a* of the connecting link 122 is rotatably mounted to the link base 123 with the connecting pin 125, and the leg portion 121*b* of the hand grip 121 is rotatably mounted to the distal end portion 122*b* of the connecting link 122 with the connecting pin 126. As illustrated in FIG. 37, through use of the connecting pin 125, the distal end portion 122*b* of the connecting link 122 and the link base 123 are configured to be integrally connectable to each other and the leg portion 121*b* of the hand grip 121 is configured to be rotatable relative to the distal end portion 122*b* of the connecting link 122 and the link base 123. Therefore, the connecting pin 125 can be also used as a common component, and hence costs can be further reduced.

In the above-mentioned first embodiment, as illustrated in FIG. 37, through use of the connecting pin 125, the distal end portion 122*b* of the connecting link 122 and the link base 123 are configured to be integrally connectable to each other and the leg portion 121*b* of the hand grip 121 is configured to be rotatable relative to the distal end portion 122*b* of the connecting link 122 and the link base 123. However, when carrying out the present invention, through use of a different connecting member instead of the connecting pin 125, the distal end portion (122*b*) of the connecting link and the link base (123) may be configured to be integrally connectable to each other and the leg portion (121*b*) of the hand grip may be configured to be rotatable relative to the distal end portion (122*b*) of the connecting link and the link base (123).

Further, in the above-mentioned first embodiment, the guide 111*f* (including the first guide groove 111*f*1 and the second guide groove 111*f*2) is arranged at the frame 111 and the protrusion (guided portion) 121*c*2, which is engaged with this guide 111*f* to be guided thereby, is arranged at the arm portion 121*c* of the hand grip 121. However, when carrying out the present invention, for example, a guide portion arranged at a frame may be a protrusion and a guided portion arranged at an arm portion of a hand grip may be a guide groove (portion engageable with the protrusion serving as the guide portion). Therefore, various modifications may be made to the present invention.

Note that, when carrying out the present invention, without mounting respective actuators adjacent to the front lock (201) and the rear lock (202), for example, a single actuator (close actuator) for releasing the front lock (201) and the rear lock (202) via a remote controller may be provided as disclosed in JP 2011-132771 A. Further, when carrying out the present invention, without mounting the actuator adjacent to the fully opened lock (203), for example, an actuator (release actuator) for releasing the fully opened lock (203) via a remote controller may be provided as disclosed in JP 2011-132771 A. Further, when carrying out the present invention, instead of adopting the above-mentioned close and release actuators, a single actuator having function and operation equivalent to those of the close and release actuators may be adopted.

Moreover, in the above-mentioned first embodiment, the configuration (configuration in which the inertia stopper 133 and the spring 134 are arranged at the lever 132) for the measure against the inertia due to collision of the vehicle or the like (safety improvement so as not to generate the operation force for releasing the fully opened latch mechanism) is adopted in a system configured so that the hand grip 121 is moved through the door closing operation in the same direction as the door closing direction to move the slide door 200 in the fully opened state to the closed position, to thereby generate the operation force for releasing the fully opened lock 203 (fully opened latch mechanism) for retaining the slide door 200 in the fully opened state. However, when carrying out the present invention, the configuration (configuration of the above-mentioned embodiment in which the inertia stopper 133 and the spring 134 are arranged at the lever 132) for the measure against the inertia due to collision of the vehicle or the like may be adopted in a system configured so that the hand grip is also operated in the same direction as the door closing direction when the slide door is in the fully closed state, to thereby generate an operation force for releasing the fully closed latch mechanism. In this case, the hand grip is not moved in the door closing direction by the above-mentioned inertia, and in the vehicle in which the slide door is in the fully closed state, the operation force for releasing the fully closed latch mechanism, which retains and locks the slide door in the fully closed state, is not generated.

Further, in the above-mentioned first embodiment, the closing operation switch S1 that operates in accordance with the door closing operation of the hand grip 121 is configured to operate in accordance with the movement of the connecting link 122 as illustrated in FIGS. 1, 28, and 29. However, when carrying out the present invention, the closing operation switch S1 that operates in accordance with the door closing operation of the hand grip 121 may be configured to operate in accordance with the movement of the arm portion 121*c* of the hand grip 121 as in a second embodiment of the present invention illustrated in FIGS. 38, 39, and 40.

Figure 38:
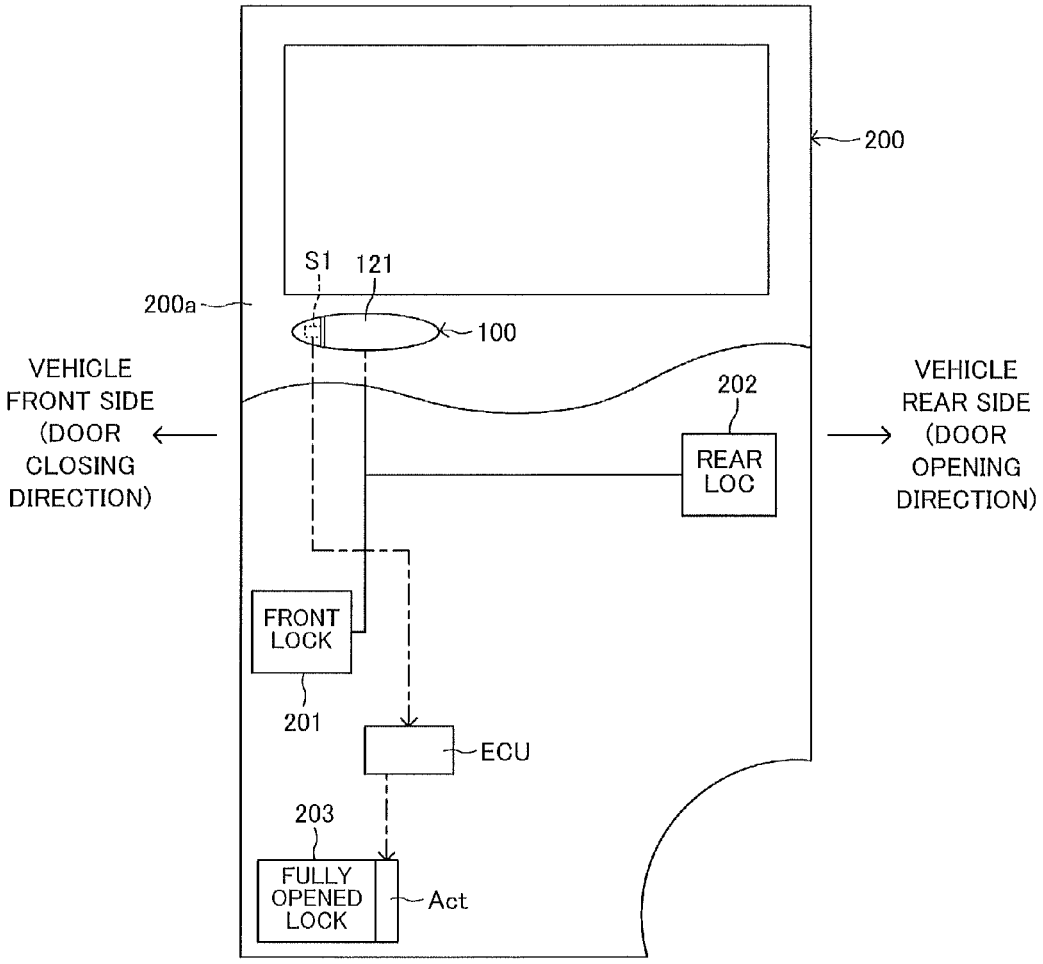
FIG. 38 is a side view schematically illustrating a slide door for a vehicle including a door handle device for a vehicle according to a second embodiment of the present invention.
Figure 39:
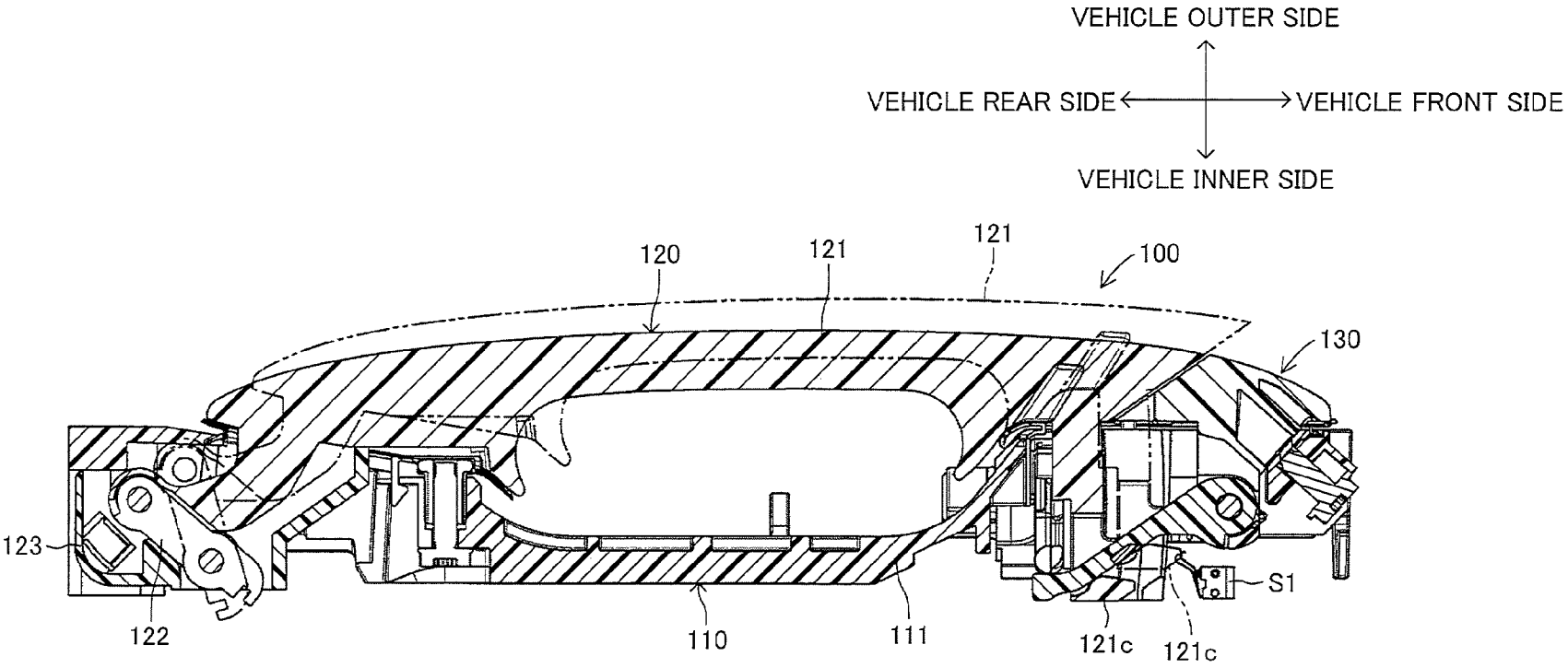
FIG. 39 is a cross-sectional plan view taken transversely along the center line of the door handle device for a vehicle corresponding to FIG. 28, for illustrating a relation between the closing operation switch and the hand grip according to the second embodiment illustrated in FIG. 38.
Figure 40:
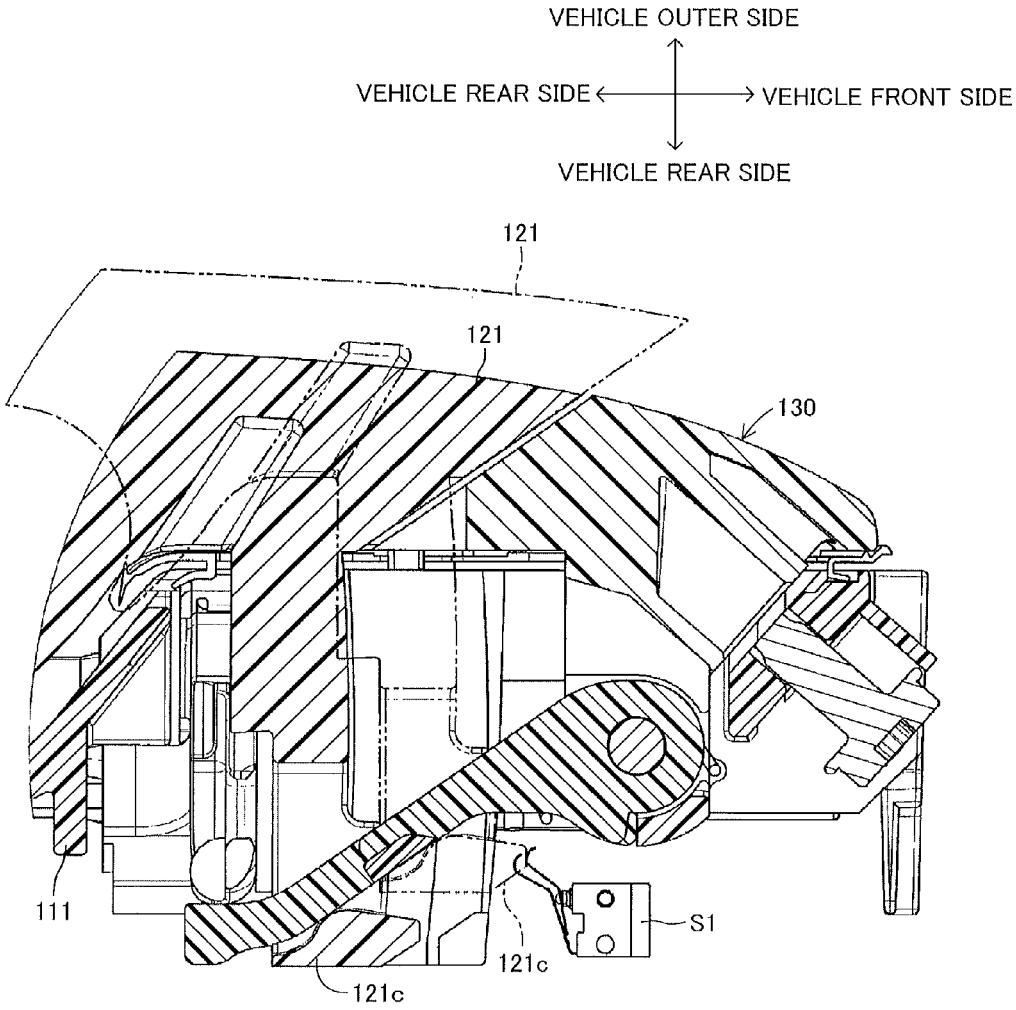
FIG. 40 is an enlarged view of a right portion (vehicle front portion) of FIG. 39.

The closing operation switch S1 of the second embodiment operates in accordance with the door closing operation of the hand grip 121 (operation of the hand grip 121 moving from an initial position indicated by the solid lines to a position indicated by the two-dot chain lines) as illustrated in detail in FIGS. 38, 39, and 40. The closing operation switch S1 is removably mounted to the frame 111 through an intermediation of a bracket (not shown) and can electrically detect movement of the arm portion 121*c* of the hand grip 121 from an initial position indicated by the solid lines to a closing operation position indicated by the two-dot chain lines. An electrical detection signal of the closing operation switch S1 is configured to be input to the electrical control unit ECU as illustrated in FIG. 38, and the electrical actuator Act mounted adjacent to the fully opened lock 203 is configured to operate based on this detection signal so that the release operation of the fully opened lock 203 is performed. Note that, when the release operation of the fully opened lock 203 is performed, the slide door 200 retained and locked in the fully opened state by the fully opened lock 203 is released and the slide door 200 in the fully opened state can be operated in the door closing direction (the slide door 200 can be moved in the vehicle front-rear direction).

In the second embodiment configured described above, locking of the fully opened lock 203 can be released by an electrical drive method (an operation force applied to the hand grip 121 is regarded as a trigger, and when this trigger is detected by the closing operation switch S1, retaining and locking of the fully opened lock 203 are released by a drive force obtained from the electrical actuator Act). Therefore, the operation force of the hand grip 121 in the door closing direction (operation force required to release locking of the fully opened lock 203) can be reduced in the door closing operation of the slide door 200.

Further, in the second embodiment, the closing operation switch S1 is removably mounted to the frame 111. Therefore, the hand grip 121 can be mounted to the frame 111 in a state in which the closing operation switch S1 is not mounted to the frame 111. When mounting the hand grip 121 to the frame 111, the closing operation switch S1 or wire harness (not shown) mounted to this switch S1 do not hinder, and hence mountability of the hand grip 121 to the frame 111 can be improved.

Further, in the second embodiment, the closing operation switch S1 is arranged to correspond to an end portion of the hand grip 121, which is close to an end portion of the slide door (to an end portion of the hand grip 121, which is located in proximity to a front end portion of the slide door 200, i.e., a left end portion in FIG. 38). Therefore, a short-length routing of the wire harness (not shown) mounted to the closing operation switch S1 to be pulled out from the closing operation switch S1 (routing in the slide door 200, for example, by bypassing a window) can be easily established in the slide door 200, compared with a case where a closing operation switch (S1) is arranged to correspond to an end portion of the hand grip 121, which is close to an intermediate portion of the slide door (to a right end portion in FIG. 38). Therefore, mountability of the wire harness can be improved and costs can be reduced.

In the above-mentioned first and second embodiments, the front lock 201 and the rear lock 202 (fully closed latch mechanism) are configured to mechanically operate in accordance with the door opening operation of the hand grip 121, and the fully opened lock 203 (fully opened latch mechanism) is configured to electrically operate in accordance with the door closing operation of the hand grip 121. However, when carrying out the present invention, the front lock 201 and the rear lock 202 (fully closed latch mechanism) may be configured to mechanically operate in accordance with the door opening operation of the hand grip 121, and the fully opened lock 203 (fully opened latch mechanism) may be configured to mechanically operate in accordance with the door closing operation of the hand grip 121. Alternatively, when carrying out the present invention, the front lock 201 and the rear lock 202 (fully closed latch mechanism) may be configured to electrically operate in accordance with the door opening operation of the hand grip 121, and the fully opened lock 203 (fully opened latch mechanism) may be configured to electrically operate in accordance with the door closing operation of the hand grip 121.

Figure 41:
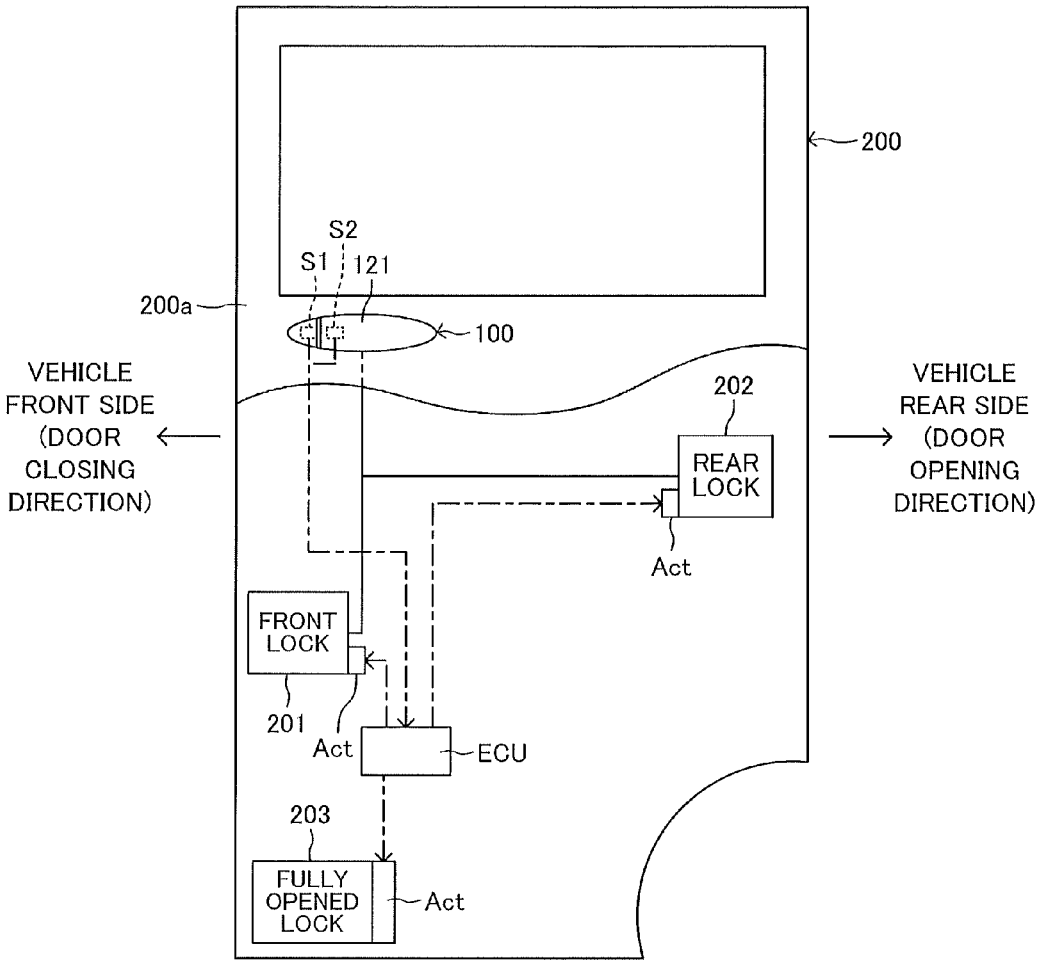
FIG. 41 is a side view schematically illustrating a slide door for a vehicle including a door handle device for a vehicle according to a third embodiment of the present invention.
Figure 42:
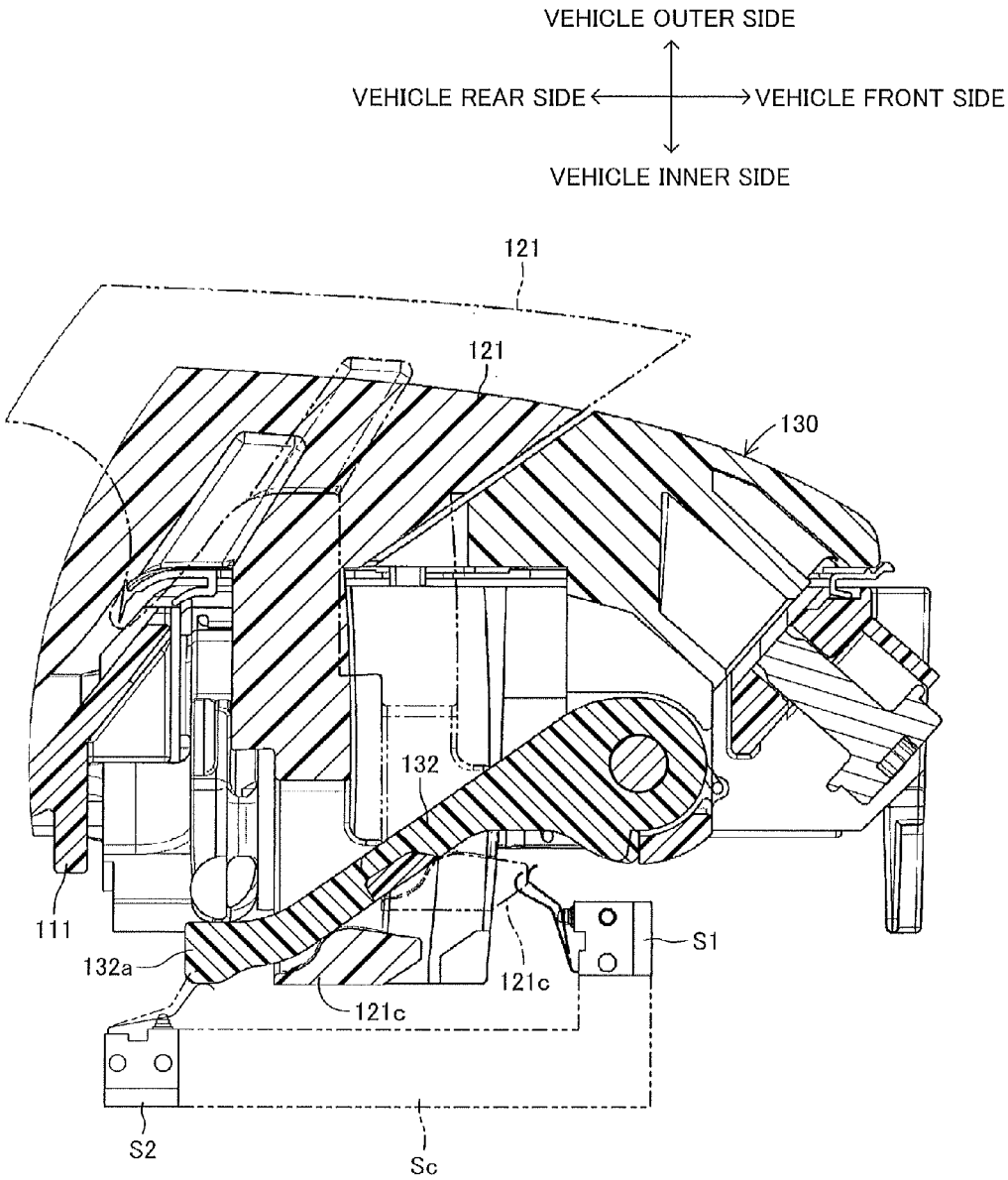
FIG. 42 is an enlarged view corresponding to FIG. 40, for illustrating a relation among the closing operation switch, an opening operation switch, and the hand grip according to the third embodiment illustrated in FIG. 41.

In addition, when carrying out the present invention, as in a third embodiment of the present invention illustrated in FIGS. 41 and 42, the front lock 201 and the rear lock 202 (fully closed latch mechanism) may be configured to mechanically and electrically operate in accordance with the door opening operation of the hand grip 121, and the fully opened lock 203 (fully opened latch mechanism) may be configured to electrically operate in accordance with the door closing operation of the hand grip 121.

In the third embodiment illustrated in FIGS. 41 and 42, an opening operation switch S2 that operates in accordance with the door opening operation of the hand grip 121 is provided so that the front lock 201 and the rear lock 202 (fully closed latch mechanism) electrically operate in accordance with the door opening operation of the hand grip 121, and electrical actuators (Act) for releasing retaining and locking of the front lock (201) and the rear lock (202) in accordance with the operation of this opening operation switch S2 are mounted adjacent to the front lock (201) and the rear lock (202), respectively.

The opening operation switch S2 illustrated in FIGS. 41 and 42 operates in accordance with the door opening operation of the hand grip 121 (operation to move the hand grip 121 from an initial position indicated by the solid lines in FIG. 42 to a position indicated by the two-dot chain lines in FIG. 42). The opening operation switch S2 is mounted to the frame 111 together with the closing operation switch S1 through an intermediation of the bracket (not shown). The opening operation switch S2 can electrically detect movement of the lever 132 toward the vehicle outer side. An electrical detection signal of this opening operation switch S2 is configured to be input to the electrical control unit ECU illustrated in FIG. 41 in the same way as the electrical detection signal of the closing operation switch S1. The actuators Act mounted adjacent to the front lock 201 and the rear lock 202 are configured to operate based on this detection signal so that release operations of the front lock 201 and the rear lock 202 are performed. Note that, when the release operations of the front lock 201 and the rear lock 202 are performed, the slide door 200 retained and locked in the fully closed state by the front lock 201 and the rear lock 202 is released and the slide door 200 in the fully closed state can be operated in the door opening direction.

In the above-mentioned third embodiment, both locking of the front lock 201 and the rear lock 202 (fully closed latch mechanism) and locking of the fully opened lock 203 (fully opened latch mechanism) can be released by an electrical drive method. Therefore, the operation force of the hand grip 121 (operation force required to release locking of each latch mechanism) can be reduced in any of the door opening operation and the door closing operation of the slide door 200.

Further, in the above-mentioned third embodiment, the opening operation switch S2 is arranged in the same way as the closing operation switch S1 to correspond to the end portion of the hand grip 121, which is close to the end portion of the slide door. Therefore, mountability of each wire harness (not shown) mounted to each of the switches S1, S2 to be pulled out from each of the switches S1, S2 can be improved and costs can be reduced. In addition, a grounding wire in each wire harness can be shared. Therefore, the wire harness can be substantially formed by three electrical wires (one grounding wire and two respective signal (power supply) wires). With this configuration as well, costs can be reduced.

Further, in the above-mentioned third embodiment, the opening operation switch S2 and the closing operation switch S1 are integrated with each other through an intermediation of a connection body Sc (see FIG. 42) indicated by the two-dot chain lines, such as a mounting bracket. Therefore, mountability of the closing operation switch S1 and the opening operation switch S2 can be improved (man-hours for mounting can be reduced) compared with a case where the closing operation switch S1 and the opening operation switch S2 are separately provided and respectively mounted. Note that, in the configuration in which the opening operation switch S2, the closing operation switch S1, and the connection body Sc are integrated with one another, a bus bar may be adopted instead of the electrical wires inside the configuration.

Note that, when carrying out the above-mentioned third embodiment, without mounting the respective actuators adjacent to the front lock (201) and the rear lock (202), for example, a single actuator (close actuator) for releasing the front lock (201) and the rear lock (202) via a remote controller may be provided as disclosed in JP 2011-132771 A. Further, when carrying out the present invention, without mounting the actuator adjacent to the fully opened lock (203), for example, an actuator (release actuator) for releasing the fully opened lock (203) via a remote controller may be provided as disclosed in JP 2011-132771 A. Moreover, when carrying out the present invention, instead of adopting the above-mentioned close and release actuators, a single actuator having function and operation equivalent to those of the close and release actuators may be adopted.

The invention claimed is:

1. A door handle device for a vehicle, comprising:

a frame configured to be fixed to an outer panel of a slide door of the vehicle from a door inner side and arranged along a vehicle front-rear direction;

a link base configured to be mountable to one end portion of the frame through the outer panel;

a connecting link rotatably mounted to the link base at a base end portion of the connecting link and being swingable in the vehicle front-rear direction;

a hand grip mounted to the outer panel from a door outer side;

a leg portion configured to be arranged at one end portion of the hand grip, rotatably mounted to a distal end portion of the connecting link, and inserted together with the link base and the connecting link to the one end portion of the frame through the outer panel;

an arm portion configured to be arranged at another end portion of the hand grip and inserted to another end portion of the frame through the outer panel, the arm portion including an insertion hole;

a grip portion arranged between the leg portion and the arm portion and extending along the vehicle front-rear direction at a vehicle outer side;

a cap mounted to the frame from the door outer side in a state in which the outer panel is sandwiched between the frame and the cap at the another end portion of the hand grip;

a lever mounted to the cap to be tiltable in a vehicle inward-outward direction and configured to be inserted into the insertion hole of the arm portion through the outer panel;

a first biasing member for biasing the hand grip toward an initial position relative to the frame; and a second biasing member for biasing the connecting link toward an initial position relative to the frame, wherein when the hand grip is moved through a door opening operation in the same direction as a door opening direction to move the slide door in a fully closed state to an opened position, the hand grip is moved from the initial position in the door opening direction against a biasing force of the first biasing member and the lever tilts toward the vehicle outer side to generate an operation force for releasing a fully closed latch mechanism, which retains and locks the slide door in the fully closed state, and wherein when the hand grip is moved through a door closing operation in the same direction as a door closing direction to move the slide door in a fully opened state to a closed position, the hand grip and the connecting link are moved from the initial positions in the door closing direction against a biasing force of the second biasing member and the connecting link swings in the door closing direction of the slide door to generate an operation force for releasing a fully opened latch mechanism, which retains and locks the slide door in the fully opened state.

2. A door handle device for a vehicle according to claim 1, further comprising:

a guided portion arranged at the arm portion of the hand grip;

a first guide portion arranged at the frame; and a second guide portion arranged at the frame, wherein when the hand grip is moved through the door opening operation in the same direction as the door opening direction to move the slide door in the fully closed state to the opened position, the hand grip is moved from the initial position in the door opening direction against the biasing force of the first biasing member, the lever tilts toward the vehicle outer side, and the guided portion moves along the first guide portion in the door opening direction of the slide door to generate the operation force for releasing the fully closed latch mechanism, which retains the slide door in the fully closed state, and wherein when the hand grip is moved through the door closing operation in the same direction as the door closing direction to move the slide door in the fully opened state to the closed position, the hand grip and the connecting link are moved from the initial positions in the door closing direction against the biasing force of the second biasing member, the connecting link swings in the door closing direction of the slide door, and the guided portion moves along the second guide portion in the door closing direction of the slide door to generate the operation force for releasing the fully opened latch mechanism, which retains the slide door in the fully opened state.

3. A door handle device for a vehicle according to claim 1, further comprising:

an inertia stopper tiltable relative to the lever; and a third biasing member for biasing the inertia stopper toward an initial position relative to the lever, wherein when a predetermined inertia acts in the door closing direction of the slide door, the inertia stopper is separated from the lever against a biasing force of the third biasing member and the arm portion of the hand grip is engaged with the separated inertia stopper to restrict the hand grip from moving in the door closing direction.

4. A door handle device for a vehicle according to claim 1, further comprising an anti-loosening protrusion arranged at the frame to prevent the hand grip from loosening from the frame when the lever is inserted into the insertion hole formed in the arm portion.

5. A door handle device for a vehicle according to claim 1, further comprising a closing operation switch configured to detect that the hand grip is operated in the door closing direction of the slide door, wherein when the closing operation switch detects that the hand grip is operated in the door closing direction of the slide door, the slide door retained and locked in the fully opened state by the fully opened latch mechanism is released by an electrical actuator.

6. A door handle device for a vehicle according to claim 5, wherein the closing operation switch is removably mounted to the frame.

7. A door handle device for a vehicle according to claim 5, wherein the closing operation switch is arranged to correspond to an end portion of the hand grip, which is close to an end portion of the slide door.

8. A door handle device for a vehicle according to claim 5, further comprising an opening operation switch configured to detect that the hand grip is operated in the door opening direction of the slide door, wherein when the opening operation switch detects that the hand grip is operated in the door opening direction of the slide door, the slide door retained and locked in the fully closed state by the fully closed latch mechanism is released by the electrical actuator.

9. A door handle device for a vehicle according to claim 8, wherein the closing operation switch and the opening operation switch are arranged to correspond to the end portion of the hand grip, which is close to the end portion of the slide door.

10. A door handle device for a vehicle according to claim 9, wherein the closing operation switch and the opening operation switch are integrated with each other.

11. A door handle device for a vehicle according to claim 1, wherein the distal end portion of the connecting link and the link base are configured to be integrally connectable to each other and the leg portion of the hand grip is configured to be rotatable relative to the distal end portion of the connecting link and the link base.

12. A door handle device for a vehicle according to claim 11, wherein the base end portion of the connecting link is rotatably mounted to the link base through an intermediation of a first connecting pin and the leg portion of the hand grip is rotatably mounted to the distal end portion of the connecting link through an intermediation of a second connecting pin, and wherein through use of the first connecting pin, the distal end portion of the connecting link and the link base are configured to be integrally connectable to each other and the leg portion of the hand grip is configured to be rotatable relative to the distal end portion of the connecting link and the link base.

* * * * *